US009512691B2

(12) United States Patent
Nutley et al.

(10) Patent No.: US 9,512,691 B2
(45) Date of Patent: Dec. 6, 2016

(54) ELONGATED SEALING MEMBER FOR DOWNHOLE TOOL

(71) Applicant: Swelltec Limited, Dyce, Aberdeen (GB)

(72) Inventors: Kim Nutley, Inverurie (GB); Brian Nutley, Bridge of Don (GB); Glen Robitaille, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 333 days.

(21) Appl. No.: 14/135,008

(22) Filed: Dec. 19, 2013

(65) Prior Publication Data

US 2014/0224497 A1 Aug. 14, 2014

Related U.S. Application Data

(63) Continuation of application No. 12/393,984, filed on Feb. 26, 2009, now Pat. No. 8,636,074.

(30) Foreign Application Priority Data

Feb. 27, 2008 (GB) ..... 0803517.2

(51) Int. Cl.

| | |
|---|---|
| ***E21B 31/18*** | (2006.01) |
| ***E21B 33/00*** | (2006.01) |
| ***E21B 33/12*** | (2006.01) |

(52) U.S. Cl.

CPC ..... *E21B 33/00* (2013.01); *E21B 33/1208* (2013.01); *E21B 2033/005* (2013.01); *Y10T 29/49826* (2015.01)

(58) Field of Classification Search

CPC ..... E21B 33/1208; E21B 31/18; E21B 33/12; E21B 31/00

See application file for complete search history.

(56) References Cited

U.S. PATENT DOCUMENTS

| | | | | |
|---|---|---|---|---|
| 2,167,811 | A * | 8/1939 | Martin | 277/450 |
| 2,830,540 | A | 4/1958 | Vincent | |
| 3,385,367 | A * | 5/1968 | Kollsman | 166/191 |
| 3,529,836 | A | 9/1970 | Hyde | |
| 3,865,408 | A * | 2/1975 | Young | 285/3 |
| 4,137,970 | A * | 2/1979 | Laflin et al. | 166/292 |
| 6,325,144 | B1 | 12/2001 | Turley et al. | |
| 6,581,682 | B1 | 6/2003 | Parent et al. | |
| 7,419,165 | B2 * | 9/2008 | Toth et al. | 277/569 |
| 7,762,344 | B2 | 7/2010 | Courville et al. | |
| 7,819,200 | B2 | 10/2010 | Cornelissen et al. | |
| 7,836,960 | B2 | 11/2010 | Patel et al. | |
| 7,866,408 | B2 | 1/2011 | Allison et al. | |
| 7,994,257 | B2 | 8/2011 | De et al. | |
| 2004/0020662 | A1 | 2/2004 | Freyer | |
| 2008/0093086 | A1 | 4/2008 | Courville et al. | |
| 2008/0185158 | A1 | 8/2008 | Chalker et al. | |

* cited by examiner

*Primary Examiner* — Kipp Wallace
(74) *Attorney, Agent, or Firm* — Blank Rome, LLP

(57) ABSTRACT

A downhole apparatus is described comprising a body and a sealing arrangement located on the body. The body has a longitudinal axis and the sealing arrangement comprises at least one elongated sealing member with an axis of elongation extending around the longitudinal axis. The sealing member comprises a material selected to expand on exposure to at least one predetermined fluid, such as a hydrocarbon or aqueous fluid encountered in a wellbore. A method of forming the apparatus and methods of use are described. Embodiments of the invention relate to wellbore packers.

18 Claims, 18 Drawing Sheets

ELONGATED SEALING MEMBER FOR DOWNHOLE TOOL

CROSS REFERENCE TO RELATED APPLICATIONS

This application is a continuation of U.S. patent application Ser. No. 12/393,984, filed Feb. 26, 2009, which claims priority to United Kingdom Patent Application No. GB0803517.2, filed on Feb. 27, 2008, all of which is incorporated by reference in their entirety herein.

TECHNICAL FIELD

The present invention relates to apparatus for use downhole or in pipelines, in particular in the field of oil and gas exploration and production. The invention also relates to components for and methods of forming downhole apparatus.

BACKGROUND ART

This application claims the benefit of United Kingdom Patent Application No. GB0803517.2, filed on Feb. 27, 2008, which hereby is incorporated by reference in its entirety.

In the field of oil and gas exploration and production, various tools are used to provide a fluid seal between two components in a wellbore. Isolation tools have been designed for sealing an annulus between two downhole components to prevent undesirable flow of wellbore fluids in the annulus. For example, a packer may be formed on the outer surface of a completion string which is run into an outer casing or an uncased hole. The packer is run with the string to a downhole location, and is inflated or expanded into contact with the inner surface of the outer casing or openhole to create a seal in the annulus. To provide an effective seal, fluid must be prevented from passing through the space or micro-annulus between the packer and the completion, as well as between the packer and the outer casing or openhole.

Isolation tools are not exclusively run on completion strings. For example, in some applications they form a seal between a mandrel which forms part of a specialised tool and an outer surface. In other applications they may be run on coiled tubing, wireline and slickline tools.

Conventional packers are actuated by mechanical or hydraulic systems. More recently, packers have been developed which include a mantle of swellable elastomeric material formed around a tubular body. The swellable elastomer is selected to expand on exposure to at least one predetermined fluid, which may be a hydrocarbon fluid or an aqueous fluid. The packer may be run to a downhole location in its unexpanded state, where it is exposed to a wellbore fluid and caused to expand. The design, dimensions, and swelling characteristics are selected such that the swellable mantle expands to create a fluid seal in the annulus, thereby isolating one wellbore section from another. Swellable packers have several advantages over conventional packers, including passive actuation, simplicity of construction, and robustness in long term isolation applications. Examples of swellable packers are described in GB 2411918.

FIG. 1 of the drawings shows a swellable packer according to the prior art, generally depicted at 10, formed on a tubular body 12 having a longitudinal axis L. The packer 10 comprises an expanding mantle 14 of cylindrical form located around the body 12. The expanding mantle 14 is formed from a material selected to expand on exposure to at least one predetermined fluid. Such materials are known in the art, for example from GB 2411918.

As illustrated in FIGS. 2A and 2B, the dimensions of the packer 10 and the characteristics of the swellable material of the expanding portion 14 are selected such that the expanding portion forms a seal in use, which substantially prevents the flow of fluids past the body 12. FIG. 2A is a cross-section through the packer 10 located in a wellbore 20 in a formation 22. On exposure to a wellbore fluid in the annulus 24, in this case a hydrocarbon fluid, the expanding portion 14 expands and its outer diameter increases until it contacts the surface 26 of the wellbore to create a seal in the annulus 24. The seal prevents flow of fluid in the wellbore annulus between a volume above the packer 10 and a volume below the packer 10. Although shown here in use in an uncased hole, the packer 10 could of course be used in a cased hole, in which case the mantle would form a seal against the interior surface of the outer casing.

Typically a packer will be constructed for a specific application and incorporated into a casing string or other tool string by means of threaded couplings. Swellable packers are typically constructed from multiple layers of uncured elastomeric material, such as EPDM. Multiple layers are overlaid on a mandrel or tubular in an uncured form to build up a mantle of the required dimensions. The mantle is subsequently cured, e.g. by heat curing or air curing. The outer surface of the swellable mantle is then machined using a lathe to create a smooth cylindrical surface. This method produces a fully cured, unitary swellable mantle capable of sealing large differential pressures. However, the process is generally labour-intensive and time consuming, and the uncured material can be difficult to handle. Moreover, the resulting expanding portion, although robust and capable of withstanding high pressures, may be ill-suited to some downhole applications.

In wellbore construction, cement is used to seal an annulus between a casing section and an openhole, or an annulus between two concentric tubulars, to prevent undesirable fluid flow to surface. Large volumes of cement are required to seal an annulus from a casing point back to surface, and when the casing is cemented into place, the cement forms a structural component of the wellbore.

There is generally a need to provide sealing mechanisms and isolation tools and systems which may be manufactured and assembled more efficiently than in the case of the prior art, and which are flexible in their application to a variety of wellbore scenarios.

SUMMARY OF INVENTION

It is amongst the aims and objects of the invention to overcome or mitigate the drawbacks and disadvantages of prior art apparatus and sealing systems.

According to a first aspect of the invention there is provided a downhole apparatus comprising:

a body having a longitudinal axis and a sealing arrangement located on the body;

wherein the sealing arrangement comprises at least one elongated sealing member with an axis of elongation extending around the longitudinal axis of the body, and the sealing member comprises a material selected to expand on exposure to at least one predetermined fluid.

The axis of elongation is an axis along which the sealing member is elongated, or lengthened, with respect to the dimensions in a perpendicular axis or axes of the sealing member. In other words it is the longitudinal axis of the member.

The sealing arrangement may have an expanded condition in which an annular seal is formed. The annular seal may be formed between the body and a surface external to the body, which may be substantially concentric with the body. In this instance, the sealing arrangement may be formed on an outer surface of the body, and the seal may be in an annulus formed between the body and the surface external to the body. The surface may be the internal surface of a casing or an uncased borehole. The downhole apparatus may therefore form an annular seal, which may substantially prevent fluid flow past the body.

The downhole apparatus preferably forms a part of an isolation tool or an isolation system for sealing one region of the annulus above the apparatus from another region of the annulus below the apparatus.

The terms "upper", "lower", "above", "below", "up" and "down" are used herein to indicate relative positions in the wellbore. The invention also has applications in wells that are deviated or horizontal, and when these terms are applied to such wells they may indicate "left", "right" or other relative positions in the context of the orientation of the well.

The body may be a substantially cylindrical body, and may be a tubular or a mandrel. The sealing member may extend circumferentially around the body. The sealing member may extend around the outer surface of the body, or may extend around an inner surface of the body.

The sealing member may form an expanding portion, which may be substantially cylindrical in form and may extend over a length of the body. The expanding portion may extend over a length of the body which is greater than the width of the elongated sealing member.

By creating a sealing arrangement from an elongated sealing member, it may be easier to assemble the apparatus when compared with conventional slip-on apparatus. For example, the expanding portion could be formed by securing a first end and a second end of the elongated member to the body at a part of the body which is axially displaced from an end of the body. For example, the apparatus could be formed on a central 2 meter portion of a 12 meter casing section.

An annular seal may be formed between the body and a surface internal to the body, which may be substantially concentric with the body. In this instance, the sealing arrangement may be formed on an inner surface of the body, and the seal may be in an annulus formed between the body and the surface internal to the body. The surface may be the outer surface of a second body, which may be a casing.

The elongated sealing member may be a strip, band, ribbon, bead, tape, rod, cable, conduit or another elongated form.

The sealing arrangement may consist of a single turn of the elongated member, but preferably comprises a plurality of turns. Preferably, the elongated member is coiled on the body.

The plurality of turns may be formed such that a lower edge of a turn is adjacent to an upper edge of a successive turn. The lower edge of a turn may abut an upper edge of a successive turn, and may create a seal with the upper edge of the successive turn. Alternatively, successive turns may be spaced from one another.

The elongated sealing member may comprise a material selected to expand or increase in volume on exposure to a hydrocarbon fluid, and which may be an EPDM rubber. Alternatively, or in addition, the elongated sealing member may comprise a material selected to expand on exposure to an aqueous fluid, which may comprise a super-absorbent polymer.

The sealing member may be formed by an extrusion process, which may be a co-extrusion of two or more materials. The two materials may both be selected to expand on exposure to at least one predetermined fluid, but may be selected to differ in one or more of the following characteristics: fluid penetration, fluid absorption, swelling coefficient, swelling rate, elongation coefficient, hardness, resilience, elasticity, and density. At least one material may comprise a foam. The material may be foamed through the addition of blowing agents. In some applications this will aid fluid absorption leading to faster swell rates and higher maximum swell volumes.

Alternatively, or in addition, the sealing member may be formed from an extrusion around a substrate.

In an embodiment the sealing member comprises one or more expanding components coupled to a core, a layer or another elongating component, which may have different physical properties to the expanding component. Advantageously the expanding component or components will at least partially encapsulate the elongating component to facilitate the provision of a seal.

The core may be a coated or uncoated cable or control line, and/or may comprise an expanding material. This embodiment has the advantage that a sealing member can be created with different properties by the combination of sheaths and cores of different designs. For example, the sheath may be used to encapsulate a core of expanding material having a different swelling characteristic to create a hybrid sealing member. The core may function as the substrate, or may be arranged to convey a fluid or a signal through the sealing member.

Alternatively, or in addition, the sealing member may comprise a substrate and means for attaching an expanding component to the substrate. The expanding component may comprise formations configured for attachment to a substrate and/or a recess for receiving a substrate. The expanding component may comprise a formation configured to receive an elongating component. The formation may be resilient and may retain the elongating component, for example by partially or fully surrounding the elongating component. The expanding component may comprise a substantially u-shaped or c-shaped profile which defines a longitudinal groove. The expanding component may comprise a clip-on member that clips around an elongating component, and may be bonded in position through the use of an adhesive or other bonding agent.

The sealing member may comprise a substrate which extends longitudinally to the member. The substrate may comprise a core, or may comprise a strip, band, ribbon, bead, tape, rod, cable, conduit or another elongated form. The substrate may comprise plastic, metal, fibrous, woven, or composite material. The substrate may function to provide structural strength to the sealing member, allow more tension to be imparted during application to a body, bind to the swellable material, resist expansion of the sealing member in a longitudinal direction, and/or resist swaging of the sealing member on the body.

The sealing member may comprise a conduit, which may be longitudinally oriented. The conduit may be formed by the substrate, or may be an open conduit. The conduit may be used to convey fluid, a cable, a control line, or a signal internally of the sealing member. The conduit may allow fluid access to the material of the sealing member from the interior of the conduit. In this way, the expansion of the sealing member may be triggered, at least in part, by fluid delivered through the sealing member.

The sealing member may couple control equipment on one side of a seal created by the apparatus to an apparatus on an opposing side of the seal. For example, the sealing member may comprise a power cable, a control line, a hydraulic line, or a data cable which runs from surface to an apparatus located below a seal created by the apparatus.

The elongated sealing member may comprise a substantially rectangular cross-sectional profile. Alternatively, or in addition, the elongated sealing member may comprise an interlocking profile, which may be configured such that a first side of the sealing member has a shape corresponding to the shape of the second, opposing side of the sealing member. The interlocking profile may be configured such that a first side of a turn of the sealing member on the body interlocks with a second, opposing side of an adjacent turn of a sealing member on the body. The interlocking profile may resist lateral separation of adjacent turns, and/or may resist relative slipping of adjacent turns. A bonding agent may be used to secure a first side of the sealing member to the shape of the second, opposing side of the sealing member. Where an interlocking profile is provided, the sealing member may be further secured through the use of an adhesive or other bonding agent.

The sealing member may have a profile configured for interlocking multiple layers of a sealing member on the body. The sealing member may have a stepped profile, a T-shaped profile or a triangular profile. The sealing member according to one embodiment comprises a flat first surface and a longitudinal spine protruding from an opposing surface. The sealing member may comprise stepped side surfaces.

The apparatus may further comprise means for securing the sealing member to the body, which may comprise a bonding agent. Alternatively, or in addition, the apparatus may comprise a mechanical attachment means for securing the sealing member to the body, which is preferably an end ring. The mechanical attachment means may be clamped onto the body, and may comprise a plurality of hinged clamping members. Alternatively, mechanical attachment means is configured to be slipped onto the body.

The mechanical attachment means may comprise a formation for receiving an end of the sealing arrangement, which may be an enlarged bore. The mechanical attachment means may comprise an engaging formation for engaging a part of the sealing member, which may be a longitudinal formation. The engaging formation may comprise teeth for engaging the sealing member. Alternatively or in addition, the engaging formation may comprise crimp portions.

In one embodiment, the engaging formation comprises threads configured to cooperate with the sealing member.

In a further embodiment, the mechanical attachment means comprises means for imparting tension into the elongated sealing member. The mechanical attachment means may comprise a ratchet mechanism. The mechanical attachment means may comprise an engaging portion, for engaging the elongated member, and a retaining portion, for retaining the mechanical attachment means with respect to the body. The engaging portion may be rotatable with respect to the retaining portion, and a ratchet mechanism may be disposed between the engaging and retaining portions.

The mechanical attachment means may comprise a release mechanism, which may be actuatable from surface and/or by a downhole intervention. The release mechanism may be actuatable to release tension in the elongated member. In one embodiment, the release mechanism is actuatable to release a ratchet. The release mechanism may comprise at least one frangible member, such as a shear pin.

In one embodiment, the mechanical attachment means is configured to be disposed on a coupling of a tubular, and may be referred to as a cross-coupling mechanical attachment means. Such a mechanical attachment means comprises an internal profile configured to correspond to the outer profile of the coupling, which may be raised with respect to the outer diameter of the tubular. This embodiment may be particularly advantageous where an expanding portion is required over the entire length of a tubular between couplings. The cross-coupling mechanical attachment means may comprise hinged clamps, swing bolt locking mechanisms, strap fasteners or other attachment means. The cross-coupling mechanical attachment may be wholly or partially cast from a metal (such as steel) or a plastic material.

The elongated member may comprise an attachment portion configured to be secured to the body. The attachment portion may comprise a formation configured to engage with mechanical attachment means of the apparatus. The attachment portion preferably comprises a termination, which may be a socket termination. The attachment portion may be crimped, bonded, screwed, or otherwise attached to the elongated member. In embodiments where the elongated member comprises a substrate, the attachment portion may be attached direct to the substrate.

The apparatus may be configured as a packer, a liner hanger, or an overshot tool.

The apparatus may be configured as a cable encapsulation assembly, and may comprise a support element disposed between the body and the sealing arrangement. The support element may be provided with a profile configured to receive a cable, conduit or other line. The support element may comprise a curved outer profile, and the assembly may define an elliptic outer profile. Alternatively the support element may comprise a substantially circular profile such that the assembly defines a circular outer profile.

According to a second aspect of the invention, there is provided a sealing member for a downhole apparatus, the sealing member comprising a material selected to expand on contact with at least one predetermined fluid, wherein the sealing member is elongated and is configured to be located on a body of a downhole apparatus such that its axis of elongation extends around the longitudinal axis of the body.

The sealing member is preferably configured to form an annular seal between a body and a surface external to the body, in use which may be substantially concentric with the body. In this instance, the sealing member may be configured for disposal on an outer surface of a body, and the seal may be in an annulus formed between the body and the surface external to the body. The surface may be the internal surface of a casing or an uncased borehole. The sealing member is therefore configured to form an annular seal, which may substantially prevent fluid flow past the body.

The sealing member may be configurable to form an expanding portion, which may be substantially cylindrical in form and may extend over a length of a body. The expanding portion may extend over a length of the body, which may be greater than the width of the sealing member.

The sealing member may be configured for disposal between a body and a surface internal to the body, which may be substantially concentric with the body. In this instance, the sealing member may be configured for disposal on an inner surface of the body, and the seal may be in an annulus formed between the body and the surface external to the body. The surface may be the outer surface of a second body, which may be a casing or an uncased borehole.

The sealing member may be a strip, band, ribbon, bead, tape, rod, cable, conduit or another elongated form.

The sealing member of the second aspect of the invention may include one or more of the optional or preferred features of the sealing member/elongated sealing member of the first aspect of the invention.

According to a third aspect of the invention there is provided a method of forming a downhole apparatus, the method comprising the steps of:

(a) Providing a body having a longitudinal axis;

(b) Providing at least one elongated sealing member comprising a material selected to expand on exposure to at least one predetermined fluid;

(c) Forming a sealing arrangement on the body by locating the at least one elongated sealing member on the body, with its axis of elongation extending around the longitudinal axis of the body.

The method may comprise the step of forming multiple turns of the elongated sealing member on the body.

The elongated sealing member may comprise a power cable for a downhole apparatus.

According to a fourth aspect of the invention, there is a provided a method of forming a seal in a downhole environment, the method comprising the steps of:

(a) Configuring a sealing apparatus from a body and at least one elongated sealing member arranged on the body and comprising a material selected to expand on exposure to at least one predetermined fluid;

(b) Running the sealing apparatus to a downhole location such that the sealing apparatus is disposed adjacent a surface;

(c) Exposing the elongated sealing member to at least one fluid to expand it to an expanded condition, in which a seal is created between the body and the surface.

According to a fifth aspect of the invention, there is provided method of constructing a wellbore, the method comprising the steps of:

(a) Assembling a first casing string from a plurality of casing sections;

(b) Forming at least one sealing arrangement on the casing from at least one elongated sealing member comprising a material selected to expand on exposure to at least one predetermined fluid;

(c) Running the first casing string to a downhole location;

(d) Exposing the sealing arrangement to at least one wellbore fluid, thereby expanding the sealing arrangement into contact with a downhole surface.

The method may comprise the step of forming sealing arrangements over a majority of the length of the casing string. The downhole surface may be the surface of an openhole, or may be the surface of a downhole casing.

The method may comprise the step of running a second casing string inside the first casing string. The method may comprise the step of forming at least one sealing arrangement on the second casing from at least one elongated sealing member comprising a material selected to expand on exposure to at least one predetermined fluid.

The method may further comprise the step of exposing the sealing arrangement of the second casing to at least one wellbore fluid, thereby expanding the sealing arrangement into contact with the first casing string. The method may be repeated with third, fourth and other casing strings.

Thus the invention provides a method of wellbore construction in which a sealing arrangement formed from an elongated sealing member is located between concentric casings. Such an arrangement may be used as an alternative to cemented completions, or in conjunction with cement to provide an enhanced sealing capability.

According to a sixth aspect of the invention, there is provided a wellbore packer comprising an expanding portion formed from an elongated sealing member coiled around a body, the elongated sealing member comprising a material selected to expand on exposure to at least one predetermined fluid.

In one aspect of the invention, the sealing member is a power cable, which may be a power cable for an Electrical Submersible Pump (ESP).

According to a seventh aspect of the invention, there is provided an elongated member for forming a wellbore packer, the elongated member comprising a material selected to expand on exposure to at least one predetermined fluid.

According to an eighth aspect of the invention, there is provided a storage reel comprising a length of elongated member in accordance with any of the above aspects of the invention.

According to a ninth aspect of the invention, there is provide an overshot tool comprising a tubular body and an opening configured to be disposed over a body to be coupled in use, and a sealing arrangement arranged on the inner surface of the tubular body, wherein the sealing arrangement comprises at least one elongated sealing member with an axis of elongation extending around the longitudinal axis of the body, and the sealing member comprises a material selected to expand on exposure to at least one predetermined fluid.

The overshot tool may be configured to form part of an expansion joint. The body may be a mandrel, which may have a low friction surface. Alternatively or in addition, the body may be an end of a tubular in a downhole or subsea location.

The sixth to the ninth aspects of the invention may include one or more of the optional or preferred features of the sealing member/elongated sealing member of the first aspect of the invention.

DESCRIPTION OF EMBODIMENTS

Figure 1:
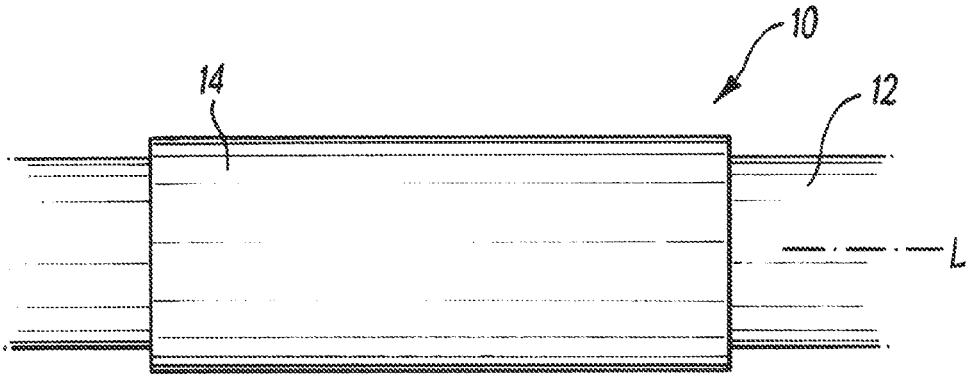
FIG. 1 (Prior Art)
FIG. 1 is a side view of a prior art wellbore packer.
Figure 2A:
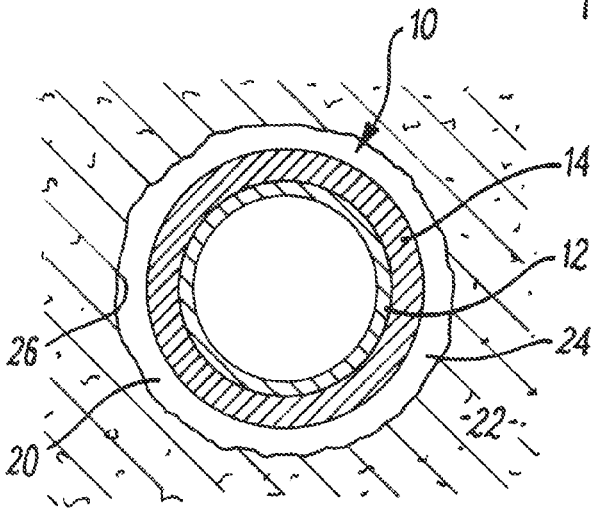
FIG. 2A (Prior Art)
FIGS. 2A and 2B are schematic cross-sectional views of a prior art wellbore packer in use in unexpanded and expanded conditions respectively.
Figure 2B:
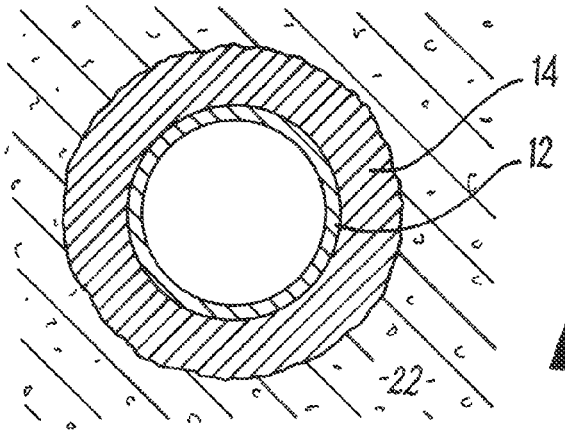
FIG. 2B (Prior Art)
Figure 3:
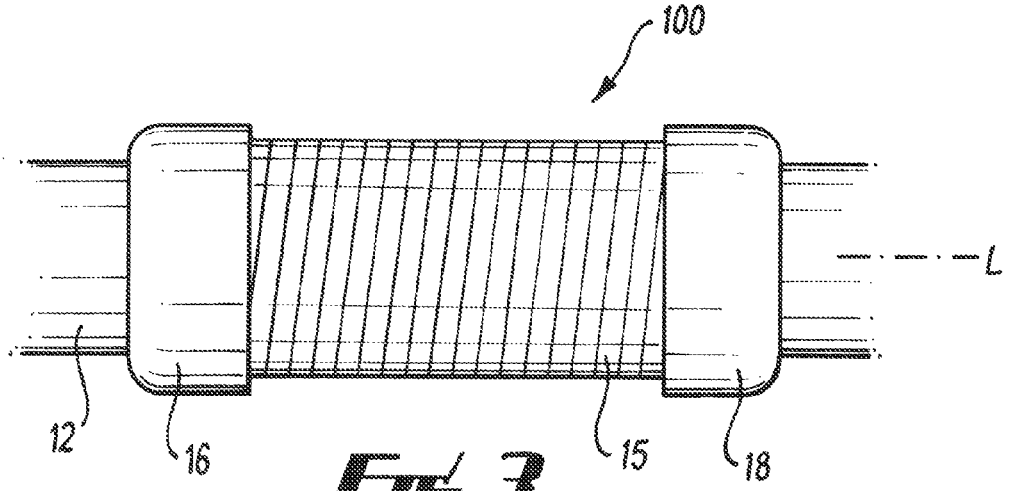
FIG. 3 is a side view of a packer in accordance with an embodiment of the invention.

Referring to FIG. 3 of the drawings, there is shown schematically an aspect of the invention embodied as a wellbore packer, generally depicted at 100, formed on a tubular body 12 having a longitudinal axis L. The packer 100 comprises an expanding portion 15 of cylindrical form located around the body 12 and a pair of end rings 16, 18 located respectively at opposing ends of the expanding portion 15. The expanding portion 15 is formed from a material selected to expand on exposure to at least one predetermined fluid. In this embodiment, the swellable material is EPDM, selected to expand on exposure to a hydrocarbon fluid. The functions of the end rings 16, 18 include: providing stand-off and protection to the packer 100 and the tubular 12, axially retaining the expanding portion 15, and mitigating extrusion of the expanding portion 15 in use. The operation of the packer 100 can be understood from FIGS. 2A and 2B and the accompanying text.

Figure 4:
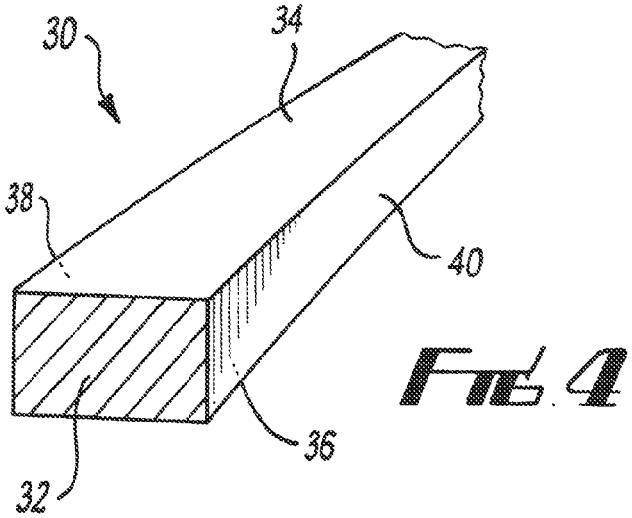
FIG. 4 is a perspective view of a part of a sealing member in accordance with the first embodiment of the invention.

FIG. 4 of the drawings shows a sealing member 30 used to form packer 100. The sealing member 30 consists of an elongated band of the swellable material which is used to form the expanding portion 15. In this example, the sealing member 30 is extruded EPDM with a substantially rectangular cross-sectional profile, and is fully cured. The sealing member 30 comprises a first end 32, and top, bottom and side surfaces 34, 36, 38 and 40 respectively. FIG. 4 shows a short sample of the sealing member 30, which will typically be formed in a continuous length of several tens or hundreds of meters.

Figure 5A:
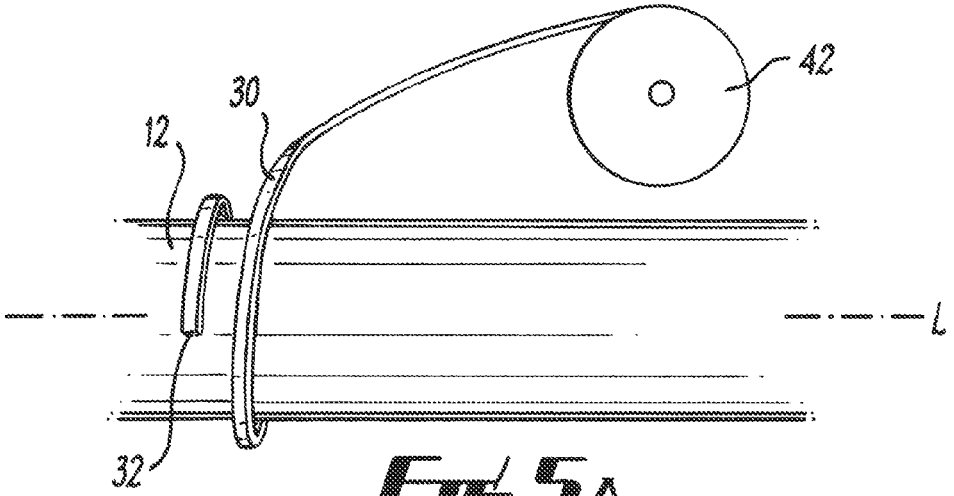
FIGS. 5A to 5C are schematic views of the apparatus of FIG. 3 in various stages of construction.
Figure 5B:
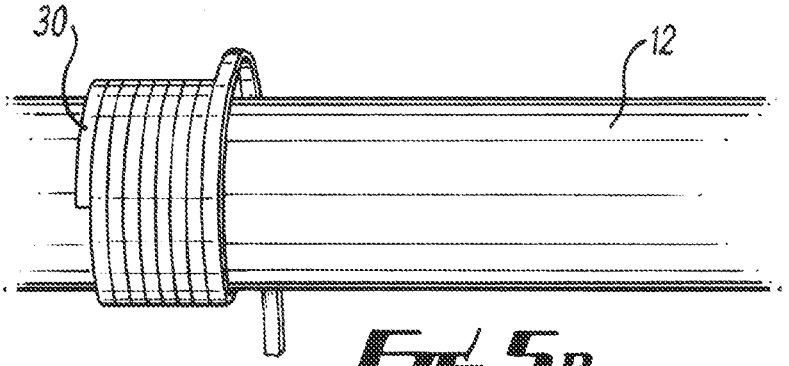
Figure 5C:
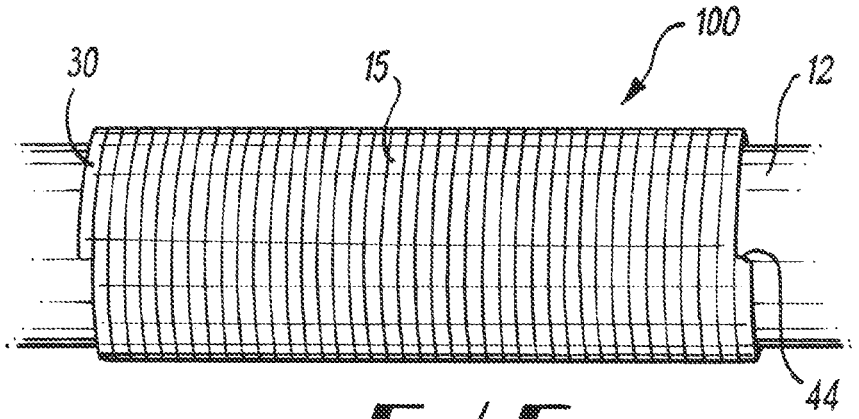

FIGS. 5A to 5C illustrate how the sealing member 30 is applied to body 12 to form the expanding portion 15 of the packer 100. The sealing member 30 is deployed from a storage reel 42, on which several tens or hundreds of meters of the sealing member is stored. The bottom surface 36 at first end 32 is located on and attached to the outer surface of the tubular body 12 by a bonding agent, and a length of the sealing member proximal the first end is coiled around the longitudinal axis L of the body 12. In this embodiment, the bonding agent used is a cyanoacrylate-based adhesive, but other bonding agents are suitable, including polyurethane-based adhesives, acrylic-based adhesives, epoxy-based adhesives or silicone-based adhesives or sealants. The sealing member 30 is further deployed and is coiled around the tubular body 12 and bonded to its outer surface, as shown in FIG. 5B, and is applied such that the side surfaces of successive turns abut one another. Tension is applied to the sealing member 30 during winding. Tension allows a seal to be created between the sealing member and the body even when the sealing member is in its unexpanded condition. To facilitate the application of the sealing member 30 to the body and maintaining tension, the sealing member may be temporarily secured to the body at its first end by a clamp (not shown). The sealing member 30 is applied to the body 12 over a length corresponding to the desired length of the packer 100, shown in FIG. 5C, which is selected according to the application and pressure conditions it is required to withstand. The sealing member 30 is cut to define second end 44, and the bottom surface 36 near to the second end is bonded to the body 12.

Figure 6:
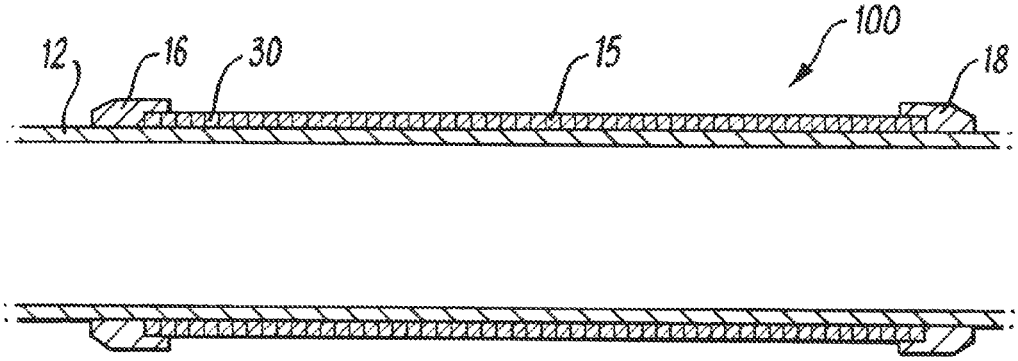
FIG. 6 is a longitudinal section through the apparatus of FIG. 3.

The sealing member is thus coiled around the body 12 to create an expanding portion 15 which is substantially cylindrical in form and extends over a length of the tool. First and second rings 16, 18 are subsequently located over the first and second ends of the expanding portion and secured to the body 12 by means of threaded bolts (not shown). The resulting tool is shown in section in FIG. 6. The end rings have an internal profile to accommodate the raised (with respect to the tubular body 12) profile of the expanding portion 15 and the discontinuities in the ends of the expanding portion due to the cut ends 32, 44 of the sealing member. In this embodiment, the end rings 16 and 18 are formed in two hinged parts (not shown), which are placed around the expanding portion 15 and the tubular 12 from a position adjacent to the apparatus, and fixed together using locking bolts (not shown). In alternative embodiments, the end rings are unitary structures slipped onto the tubular 12 from one end. In a further embodiment, the end rings may clamp over a fixed upset profile on the body 12, such as a tubing or casing coupling. Such an embodiment may be particularly advantageous where an expanding portion is required over the entire length of a tubular between couplings, and may provide an improved anchoring force for the end ring and the sealing member. In a further alternative embodiment, end rings may not be required.

The dimensions of the packer 100 and the characteristics of the swellable material of the sealing member 30 are selected such that the expanding portion forms a seal in use, which substantially prevents the flow of fluids past the body 12. The packer operates in the manner described with reference to FIGS. 2A and 2B.

The expanding portion 15 thus resembles a swellable mantle as used in conventional swelling packers, but offers several advantages and benefits when compared with conventional packer designs. For example, the sealing member 30 is economical to manufacture, compact to store, and easy to handle when compared with the materials used in conventional swellable packers.

The process of forming the packer offers several advantages. Firstly, the process does not require specialised equipment requiring large amounts of space or capital expenditure. The process can be carried out from a central portion of the tubular body, by attaching a first end of the sealing member and coiling it around the tubular, reducing the difficulties associated with slipping tool elements on at an end of the tubular and sliding them to the required location. This facilitates application of the sealing member to significantly longer tubulars, and opens up the possibility of constructed packer on strings of tubing on the rig floor immediately prior to or during assembly. The construction process allows for a high degree of flexibility in tool design. For example, a packer of any desired length can be created from the same set of components, simply by adjusting the length over which the sealing member is coiled on the tubular body. Packers and seals can be created on bodies and tubulars of a range of diameters. The principles of the invention also inherently allow for engineering tolerances in the dimensions of bodies on which the seal is created.

The resulting packer has increased surface area with respect to an equivalent packer with an annular mantle, by virtue of the increased penetration of the fluids into the expanding portion via the small spaces between adjacent turns. This allows for faster expansion to the sealing condition. The elongated sealing member also lends itself well to post-processing, for example perforating, coating or performing analysis on a sample.

Figure 7A:
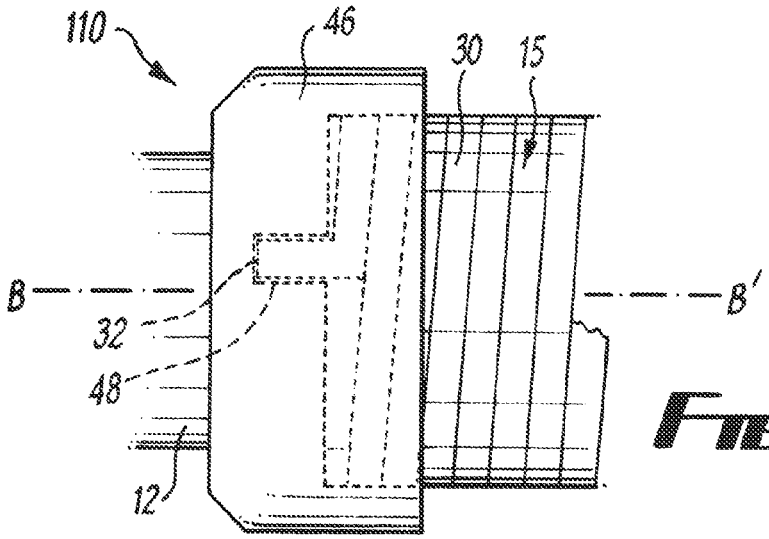
FIG. 7A is a side view showing some internal details.
Figure 7B:
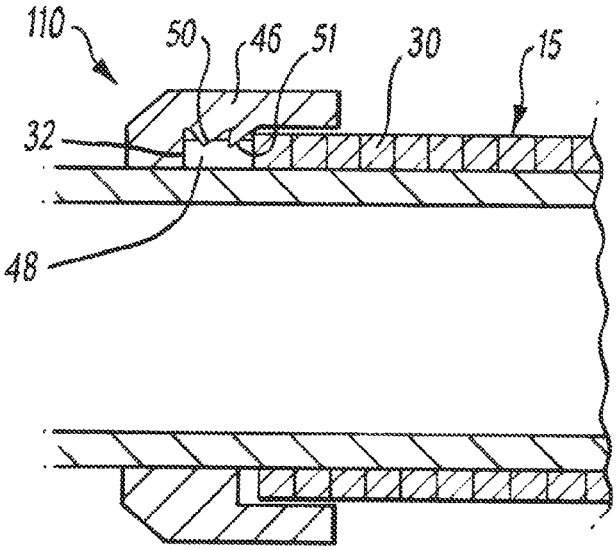
FIG. 7B is a longitudinal sectional view through an apparatus in accordance with an alternative embodiment of the invention.

FIGS. 7A and 7B show a packer 110 in accordance with an alternative embodiment of the invention. FIG. 7A is a side view of a first end and corresponding end ring 46 with some internal details shown, whereas FIG. 7B is a section of the of the same apparatus through line B-B'. The packer 110 is similar to the packer 100, formed on a tubular 12, having an expanding portion 15 formed from an elongated sealing member 30. However, the end ring 46 is provided with a machined, longitudinal formation 48 configured to receive the first end 32 of the sealing member. In this example, the first end 32 is located on the tubular 12, and the end ring 46 is clamped over the sealing member 30, with the end 32 located in the formation 48. An upper surface 50 of the recess 48 is provided with engaging teeth 51 which function to impress against the top surface 34 of the sealing member and assist in securing it against the body. A portion of the sealing member which is clear of the formation 48 is redirected in a circumferential direction and the sealing member is coiled around the tubular in the manner described with reference to FIG. 5A to 5C. The end ring 48 assists in securing the sealing member and may allow greater tension to be imparted during application. In this embodiment, the sealing member 30 is bonded to the tubular, but alternative embodiments may rely on the end rings and the applied tension to retain the expanding portion in place. An identical end ring (not shown) is provided at the opposing end of the packer 110.

Figure 8:
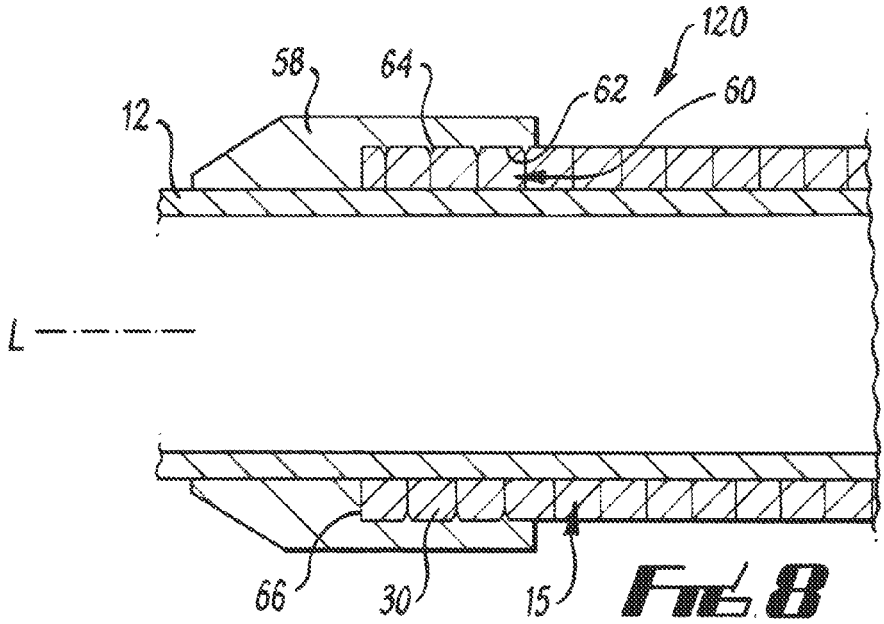
FIG. 8 is a longitudinal section through an apparatus in accordance with a further alternative embodiment of the invention.

FIGS. 8 to 11 show further alternative embodiments of packer including variant end rings. In FIG. 8, the packer 120 includes an end ring 58 includes an enlarged bore portion 60 shaped to fit over a part of the expanding portion 15. The inner surface 62 of the enlarged bore portion 60 is provided with engaging means in the form of a reverse thread 64. The thread 64 is shaped to correspond with the helix defined by the sealing member 30, and in this embodiment is received in spaces between adjacent turns of the sealing member. The packer 120 is constructed by locating the sealing member 30 on the body 12, and wrapping the sealing member to a length greater than the depth of the enlarged bore 60. The end 66 of the expanding portion is cut such that it defines a flat annular surface on a plane perpendicular to the longitudinal axis L of the body. In other words, the end 66 is squared-off. The end ring 58 is slipped onto the body 12 and threaded over the end 66 of the expanding portion. An identical end ring (not shown) is provided at the opposing end of the packer 120.

Figure 9:
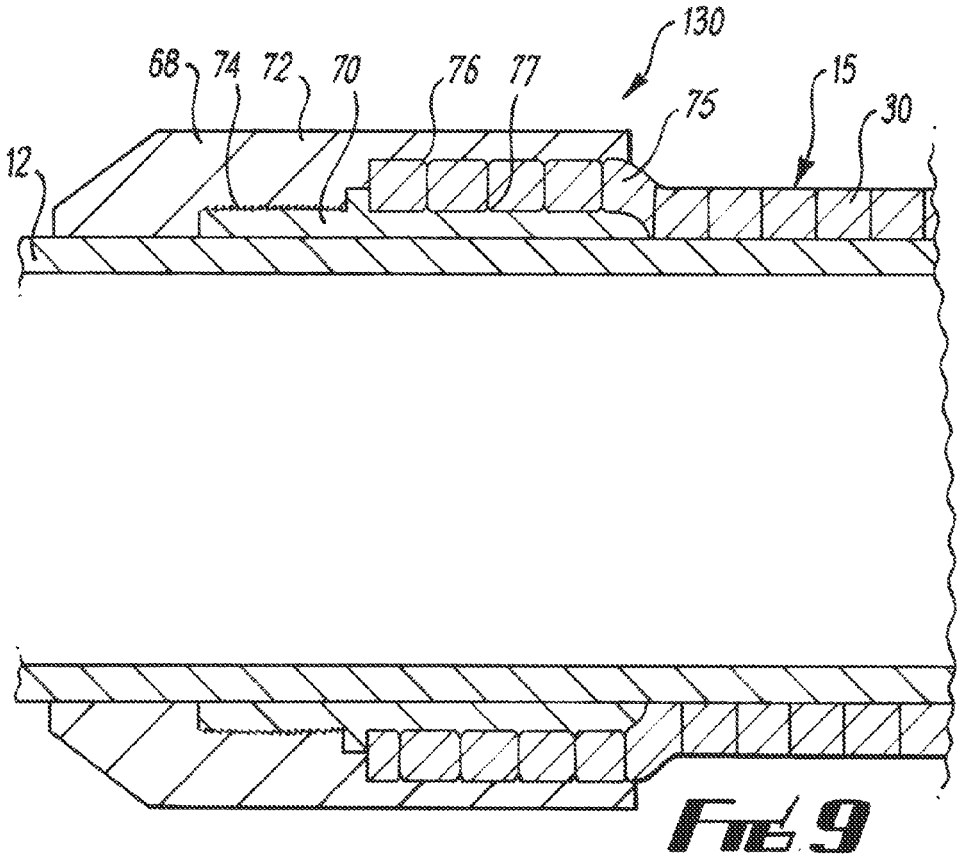
FIG. 9 is a longitudinal section through an apparatus in accordance with a further alternative embodiment of the invention.

In FIG. 9, a further alternative end ring 68 is shown on a packer 130. The end ring 68 is similar to end ring 58, but differs in that it is constructed from inner ring 70 and outer ring 72. The inner ring 70 has an internal bore shaped to fit over the tubular body 12, and has a low profile compared with the radial extent of the expanding portion 15. The inner ring 70 and the outer ring 72 are threaded together by threaded section 74 and together define an annular recess 75 for the sealing member. Surfaces of the recess 75 are provided with reverse threads 76, 77, shaped to correspond with the helix defined by the sealing member 30. During construction, the inner ring 70 is located on the body 12, and the sealing member is wrapped around the inner ring 70 and along the length of the body 12. The outer ring 72 is later threaded into engagement with the inner ring 70 and over the end of the expanding portion.

Figure 10:
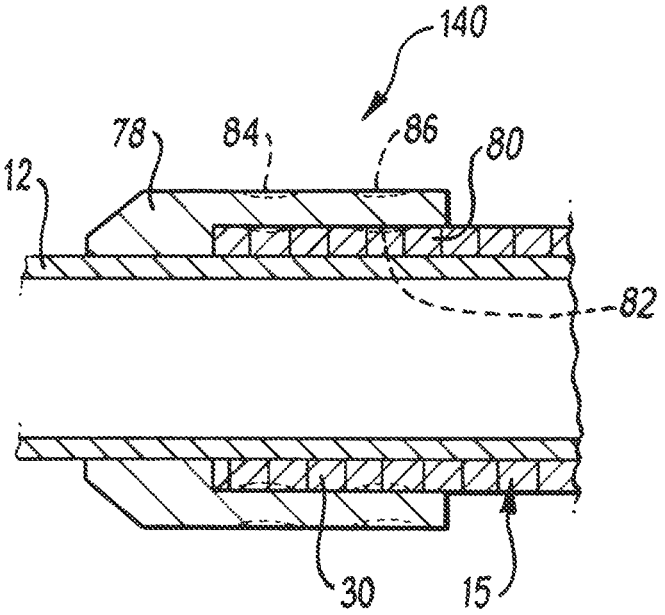
FIG. 10 is a longitudinal section through an apparatus in accordance with a further alternative embodiment of the invention.

FIG. 10 illustrates a further end ring design 78 as part of a packer 140. The end ring 78 has an enlarged bore 80 to receive the end of the expanding portion 15. The end ring 78 is crimped into engagement with the end of the expanding portion 15. To facilitate crimping, the end ring 78 has crimp portions 82, which are relatively malleable with respect to the main body of the ring, distributed around the outer circumferential surface of the ring. In this embodiment, two axially separated groups of crimp portions 84 and 86 are provided. The Figure shows the crimp portions in a depressed state into engagement with the expanding portion.

Figure 11:
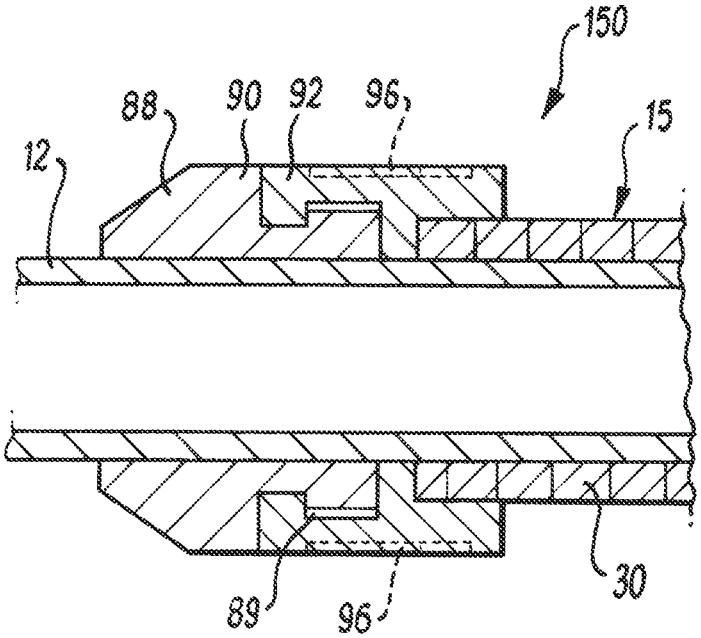
FIG. 11 is a longitudinal section through an apparatus in accordance with a further alternative embodiment of the invention.

FIG. 11 shows a further alternative end ring 88 on a packer 150. In this embodiment, the end ring 88 includes a ratchet mechanism 89, and is formed from retaining ring 90 and an engaging ring 92. The engaging ring 92 is axially keyed with the retaining ring 90, which in turn is secured to the body 12. The engaging ring has an enlarged bore portion 94 for receiving the expanding portion 15. The ratchet mechanism 89 is disposed between the engaging ring 92 and the retaining ring 90, and allows one-way relative rotation. Formations 96 are located in the outer surface of the engaging ring to assist with the engagement of a tool to rotate the ring. In this embodiment, the end of the sealing member 30 is secured to the engaging ring, and as the sealing member 30 is coiled the ratchet prevents rotation of the engaging ring. When the expanding portion is formed and the second end is secured, the engaging ring may be rotated to impart tension into the sealing member. The tension is retained by virtue of the ratchet mechanism 89.

The second, opposing end of the packer 150 is provided with a similar ratcheted end ring (not shown), configured to impart tension into the sealing member from its other end. However, in some embodiments the ratcheted end ring may only be used at one end, and may be sufficient to impart tension through the length of the sealing member. In another embodiment (not illustrated) a ratcheted ring is located between two expanding portions, and may have an engaging ring which receives an end of a sealing portion from each expanding portion. The engaging ring can be rotated to impart tension into both sealing members, with the tension retained by the ratchet. In this embodiment, the expanding portions would be formed from sealing members coiled on the tubular in opposite senses.

Further alternative embodiments of the invention include an end ring which is operable to be released, thereby releasing tension in the sealing member and breaking the seal. For example, the ratcheted end ring of FIG. 11 may be adapted to include a set of shear pins, such that an actuation from surface, for example by the application of an axial force on the end ring, shears the pins and allows the engaging ring to rotate with respect to the retaining ring. This releases tension in the sealing member, and introduces a failure mode between the body and the sealing member which ultimately breaks the seal and allows the packer to be retrieved.

In an alternative construction technique (not illustrated) a length of elongated sealing member is preformed around a formation mandrel into a helical coil to a predetermined length. The sealing member is treated such that the helical shape remains when it is removed from the mandrel. The helical coil is then slipped onto a tubular body to a required location, and secured using end rings as described above. Ratcheted end rings may be used to impart tension into the sealing member.

Figure 12A:
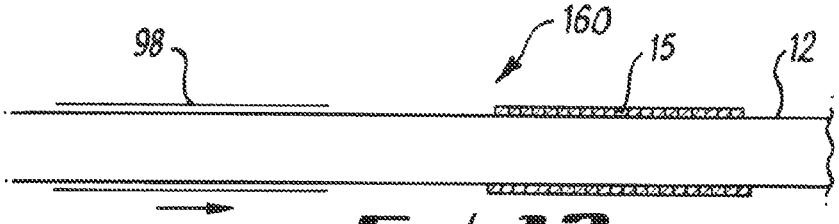
FIGS. 12A and 12B are schematic longitudinal views showing a construction method according to an embodiment of the invention.
Figure 12B:
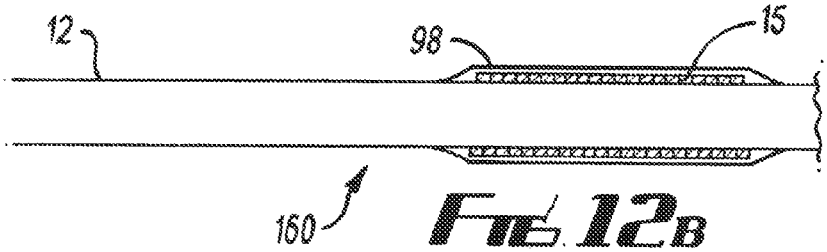

FIGS. 12A and 12B show an alternative embodiment of packer 160 and construction method in schematic form. An expanding portion 15 is formed on a tubular 12 by the method described with reference to FIG. 5A to 5C. A tubular sheath 98 of flexible material is slipped onto the tubular 12, and moved towards the expanding portion 15. The sheath 98 is resilient and elastic, and stretched over the expanding portion 15 into the position shown in FIG. 12B. The sheath 98 has a containing and protective function to the expanding portion 15 in use, and is sufficiently elastic to accommodate the expansion of the expanding portion 15. The sheath also allows control of the expansion rates of the expanding portion, by providing a layer between wellbore fluids and the swellable material, and effectively reducing the surface area by covering the spaces between adjacent turns. The material of the sheath can be selected to impervious to one or wellbore fluids, or can allow diffusion of wellbore fluids to the surface of the expanding portion. The sheath may also be perforated to increase access of wellbore fluids to the swellable material of the expanding portion. In other embodiments, the sheath is dissolved or otherwise disintegrated on exposure to wellbore fluids.

The curing state of an elastomer can be conveniently indicated using a scale, where a T100 curing state represents fully cured and cross-linked elastomer and has a corresponding curing time for a known temperature and pressure. T100 represents 100 percent of the time required to reach a fully cured state, T90 represents 90 percent of the T100 time and so on. An elastomer in its T90 state or above may be referred to as substantially fully cured, whereas an elastomer in its T30 to T90 state may be considered to be partially cured or in a semi-cured state. A substantially cured elastomer is one that exhibits similar mechanical properties and handling characteristics to a fully cured elastomer.

Figure 13A:
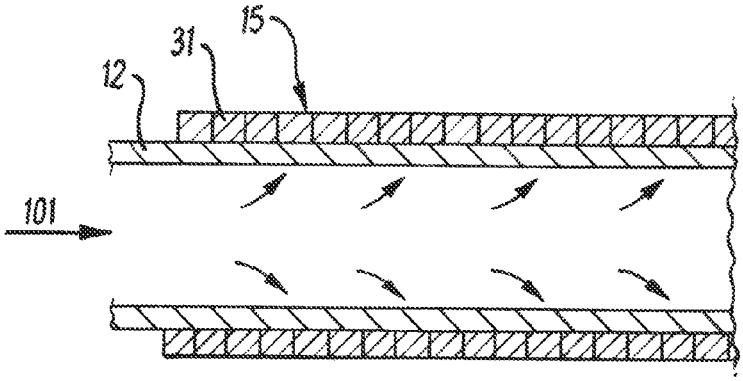
FIGS. 13A and 13B are schematic longitudinal views showing a construction method according to an alternative embodiment of the invention.
Figure 13B:
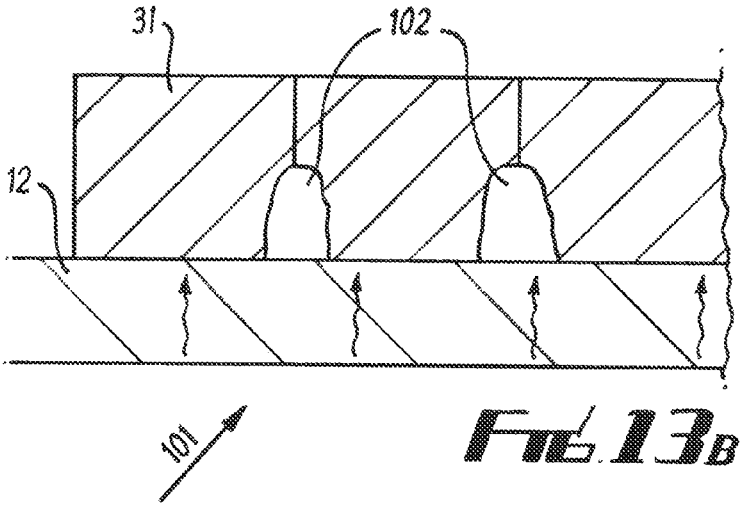

FIGS. 13A and 13B are schematic views of an alternative construction method in accordance with the invention. In this embodiment, the sealing member 31 is applied to a tubular 12 in a semi-cured state, which in this example is a T50 state, but in other embodiments could be a P30 state or lower. However, a semi-cured state in the range of T30 to T70 is preferred. Heat is then applied to the apparatus by passing hot air through the tubular in the direction of the arrows 101 in FIG. 13A. FIG. 13B is a detailed schematic view showing heat conducted through the wall of the tubular 12, and the effect of completing the curing to a substantially cured state (T90 or above) at the interfaces 102 between adjacent turns of the sealing member 31. This increases the integrity of the expanding portion 15. In other embodiments, the heat may be applied using alternative means.

Figure 14:
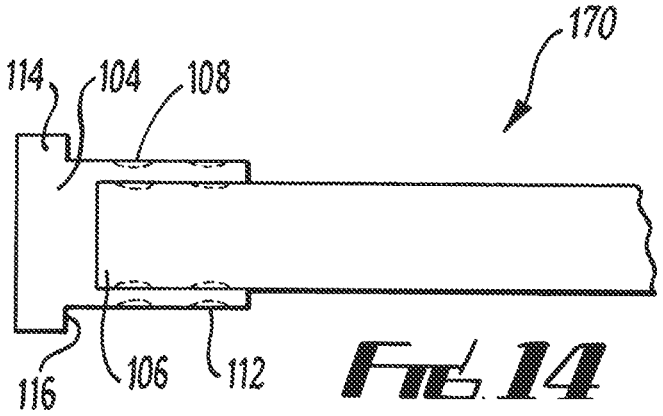
FIG. 14 is a schematic longitudinal view of a terminated sealing member according to an alternative embodiment of the invention.

FIG. 14 shows an alternative embodiment of sealing member, shown generally at 170. The sealing member 170 comprises a crimp-on terminal 104 on the end 106 of the sealing member. The terminal 104 has crimp portions which are relatively malleable with respect to the main body of the terminal, distributed around the outer circumferential surface. In this embodiment, two axially separated groups of crimp portions 108 and 112 are provided. The Figure shows the crimp portions in a depressed state in engagement with the sealing member. The terminal also comprises an end flange 114 which defines a shoulder 116. The flange 114 and shoulder 116 provide an engagement mechanism for a corresponding surface secured to the body 12, for example the ratcheted end ring of FIG. 11, allowing improved retention of the sealing member.

Figure 15:
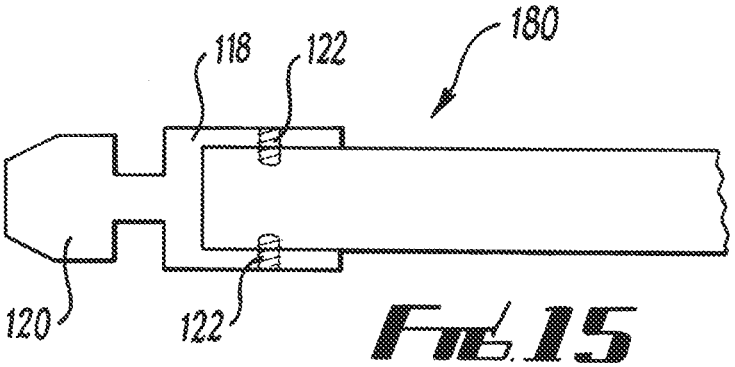
FIG. 15 is a schematic longitudinal view of a terminated sealing member according to a further alternative embodiment of the invention.

FIG. 15 shows an alternative embodiment of sealing member, shown generally at 180, comprising a socket termination 118 on the end of the sealing member. The termination comprises a male portion 120 configured to be received in a corresponding recess secured to the body 12, for example a recess provided in an end ring. The termination 118 is secured to the sealing member in this case by threaded screws 122.

Figure 16:
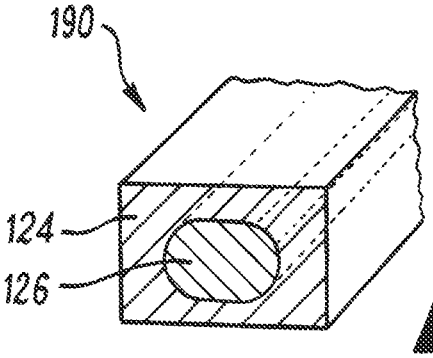
FIG. 16 is a perspective view of a part of a sealing member in accordance with an embodiment of the invention.

FIG. 16 shows in cross-section a sealing member 190 in accordance with an alternative embodiment of the invention. Sealing member 190 is similar to the sealing member 30 of FIG. 4, but differs in that it is co-extruded from two different materials to create an elongated member having different material components. The member 190 has an outer layer 124 of a first material and a core 126 of a second material. Suitable manufacturing techniques would be known to one skilled in the art of extrusion and co-extrusion of polymers and elastomers.

The outer layer 124 is of an EPDM rubber selected to expand on exposure to a hydrocarbon fluid, and having specified hardness, fluid penetration, and swelling characteristics suitable for downhole applications. The core 126 is an EPDM rubber which has a greater degree of cross-linking between molecules, compared with the material of the outer layer, and correspondingly has greater hardness, lower fluid penetration, and lower swelling characteristics than the outer layer. The core 126 also has a greater mechanical strength, and functions to increase the strength of the member as a whole when compared with sealing member 30. This allows more tension to be applied and retained in the sealing member during the construction process, and reduces any tendency of the sealing member to swage.

In another embodiment, the density of the sealing member is changed over its cross-section to create an increased porosity-permeability structure which leads to more rapid swell rates and higher swell volumes. This may be achieved by foaming the extruded member through the addition of blowing agents. Foaming can be effected over a part of the cross-section of the swellable member, to allow a greater porosity-permeability structure to be setup inside the sealing member. Co-extrusions of a foamed core with an overlying solid elastomer, or vice versa, can allow hybrid sealing members to be created having, for example with a high water swelling core and an oil swelling outer mantle.

Figure 17A:
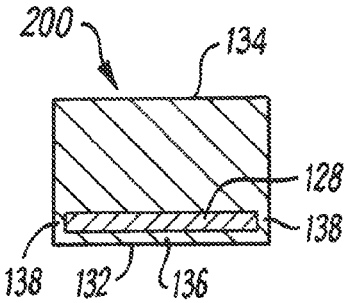
FIGS. 17A and 17B are cross-sectional views of sealing members in accordance with alternative embodiments of the invention.

FIG. 17A shows in cross-section a sealing member 200 in accordance with a further alternative embodiment of the invention. Sealing member 200 is similar to the sealing member 30 of FIG. 4, but differs in that it is extruded with a substrate 128. The substrate is in this example a ribbon, formed from a suitably malleable metal or metal alloy such as aluminium. In this example, the substrate is co-extruded with the sealing member. In alternative embodiments the substrate is selected from a plastic material, a fibrous material or a composite material, and which may be formed using an appropriate manufacturing technique, and may be extruded, moulded, cast or woven.

The substrate 128 extends along the entire length of the sealing member 200, and across the majority of its width. The substrate is asymmetrically placed with respect to the height of the sealing member 200; it is located closer to the bottom surface 132 than the top surface 134 such that there is a greater volume of swellable material located above the substrate 128 compared with the volume located between the substrate 128 and the tubular 12 in use. A thin layer 136 of the swellable material is located beneath the substrate, and thin walls 138 of swellable material are located between the sides of the substrate and the outer surface of the sealing member 200.

Figure 17B:
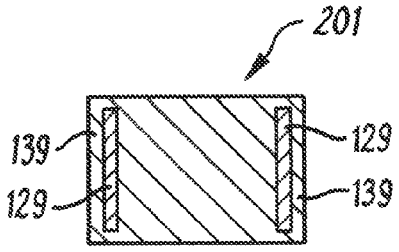

FIG. 17B shows in cross-section a sealing member 201 in accordance with a further alternative embodiment of the invention. Sealing member 201 is similar to the sealing member 200, but differs in that it is extruded with two reinforcing substrates 129. The substrates in this example are ribbons, formed from a suitable plastic material. The substrates 129 are vertically oriented and extend along the entire length of the sealing member 201, and along the majority of the height of the side wall. Thin walls 139 of swellable material are located between the substrate and the outer surface of the sealing member 201. One advantage of this embodiment is that a greater proportion of the swelling of the sealing member will be directed radially of the body in use; lateral swelling is better restrained by the substrates.

Figure 18:
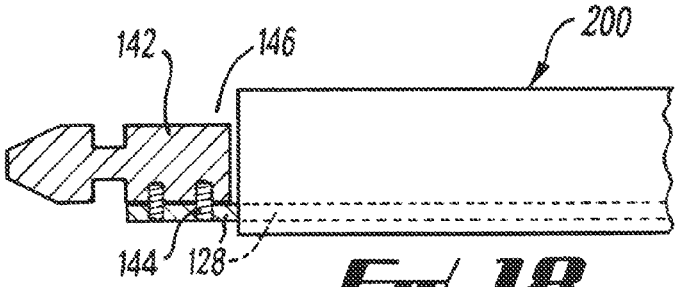
FIG. 18 is a side view of the sealing member of FIG. 17A and longitudinal section through a termination according to one embodiment.

FIG. 18 is a side view of the sealing member 200 used with a termination 142, shown in section. The termination 142 resembles the termination of FIG. 15, although in this embodiment of the termination is attached to the substrate by means of threaded bolts 144. To facilitate this, the sealing member 200 has been stripped back at an end of 146 to expose the substrate 128. The termination 142 is configured to engage with a corresponding mechanism which is attached to the tubular body 12. Tensile forces imparted along the sealing member 200 will be directed through the substrate 128, allowing more tension to be imparted during application to a tubular body, and thus a more effective internal seal to be created. The substrate 128 also functions to bind to the swellable material and resist expansion of the sealing member in a longitudinal direction. Expansion of the sealing member instead tends to be directed in a radial direction of the tubular. The substrate 128 also resists swaging of the sealing member on the tubular body.

Figure 19:
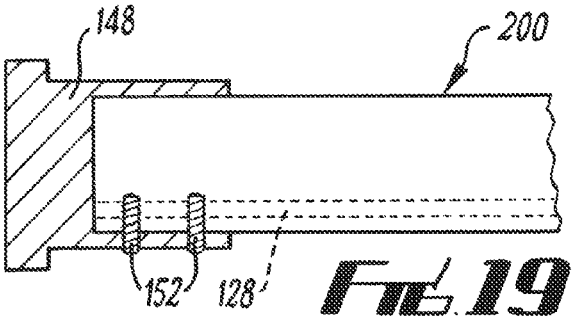
FIG. 19 is a side view of the sealing member of FIG. 17B and longitudinal section through a termination according to another embodiment.

An alternative termination 148 is shown in FIG. 19. In this embodiment, the termination is similar to that of FIG. 14, but is secured to the substrate 128 of the sealing member 200 by threaded screws 152 which extend from the outer surface of the termination 148.

Figure 20:
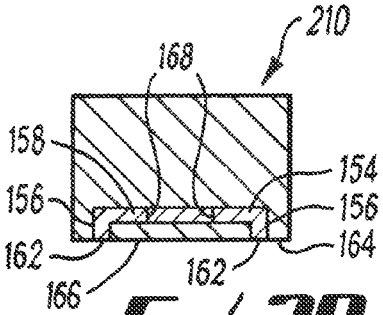
FIGS. 20 to 26 are cross-sectional views of sealing members in accordance with further alternative embodiments of the invention.
Figure 21:
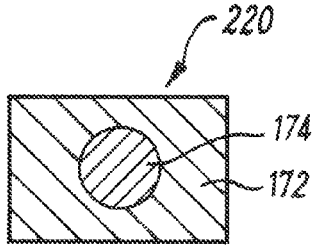

FIGS. 20 and 21 are cross-sectional views of sealing members in accordance with further alternative embodiments of the invention. FIG. 20 shows a sealing member 210 which is similar to that of FIG. 17, having a ribbon-like substrate 154 extending through the sealing member. However, in this embodiment, the substrate 154 comprises a "C-shaped" cross-sectional profile, with side walls 156 extending downwardly from the main body 158 of the substrate 154. The side walls 156 define edges 162 which are flush with the bottom surface 164 of the sealing member. Between the side walls 156 is defined a band 166 of swellable material. Fluid access to the band 166 is provided by means of laser cut apertures 168 in the substrate. The side walls 156 provide additional vertical support to the sealing member.

FIG. 21 shows a sealing member 220, similar to the sealing member 190 of FIG. 16, but having an outer layer 172 of EPDM rubber and a central core 174 consisting of a suitably malleable metal.

Figure 22:
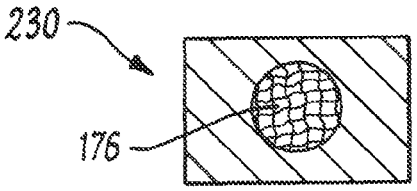

FIGS. 22 to 26 show further alternative sealing members in cross-section, all of which have an outer layer of swellable material. In FIG. 22, the sealing member 230 comprises an inner core 176 of a solid porous material. The material may be, for example, a three dimensional metallic mesh, a sintered material with the pores which permit the passage of fluid, or a braided wire, about which the sealing member is extruded. Like the substrate 128, the core provides structural strength to the sealing member, allows more tension to be imparted during application to a tubular body, binds to the swellable material, resists expansion of the sealing member in a longitudinal direction, and resists swaging of the sealing member on the tubular body. The core 176 allows fluid penetration across the core, and also in the longitudinal direction of the sealing member 230. This allows fluid to be directed through the core 176 by a exposing an open end of the sealing member to a fluid.

Figure 23:
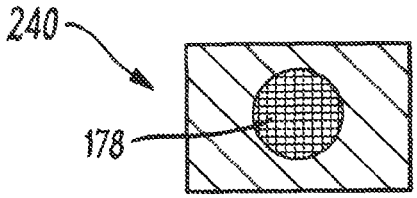

FIG. 23 shows a sealing member 240, similar to the sealing member 230, and with a core 178 comprising a woven fibrous wick which is capable of absorbing fluid across the core and in the longitudinal direction of the sealing member 240.

Figure 24:
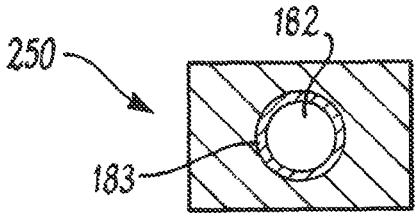

FIG. 24 shows the sealing member 250, in which a conduit 182, in this case is in the form of a hydraulic control line, forms the core of a sealing member 250. The conduit comprises a metallic wall 183 which is capable of resisting high impacts and large radial forces without collapse. Fluid may be pumped through the conduit 182.

Figure 25:
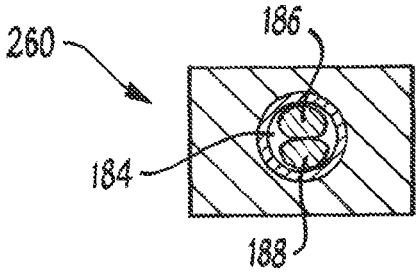

FIG. 25 shows a sealing member 260, which is similar to the sealing member 250, in that a conduit 184 forms the core of the sealing member. In this case the conduit 184 contains a bundle of smaller conduits 186, 188, which may for example be fibre optics or electrical control lines.

Figure 26:
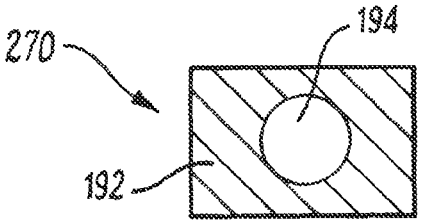

FIG. 26 shows a sealing member 270, in which an outer layer 192 has a hollow core and therefore defines an open conduit 194. The conduit 194 can be used for the supply of fluids or to receive a core or conduit of another of the embodiments of the invention.

Figure 27:
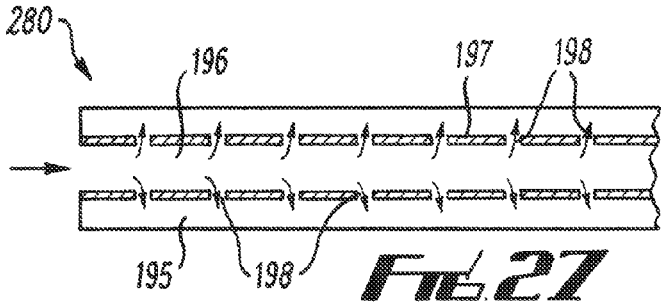
FIG. 27 is a longitudinal section through a sealing member in accordance with one embodiment of the invention.

Referring now to FIG. 27, there is shown schematically in a longitudinal section a sealing member 280 of a further alternative embodiment of the invention in use. The sealing member 280 is similar to sealing member 250 of FIG. 24. A conduit 196 forms the core of the sealing member 280, and comprises a metallic tubular wall 197 which is capable of resisting high impacts and large radial forces without collapse, and is similar in properties to a hydraulic control line. The conduit 196 is provided with a distribution of apertures 198 longitudinally and circumferentially separated along the length of the conduit wall 197. The apertures 198 allow a fluid passing through the conduit to be exposed to the swellable material that forms the outer layer 195 of the sealing member. Thus a triggering fluid used to expand the expanding portion can be delivered to the sealing member internally, via the conduit 196. This may be used to supplement the exposure of the sealing member 280 to fluid from the exterior surface. In some applications, all of the fluid required to expand the expanding portion may be provided via the conduit 196.

Figure 28A:
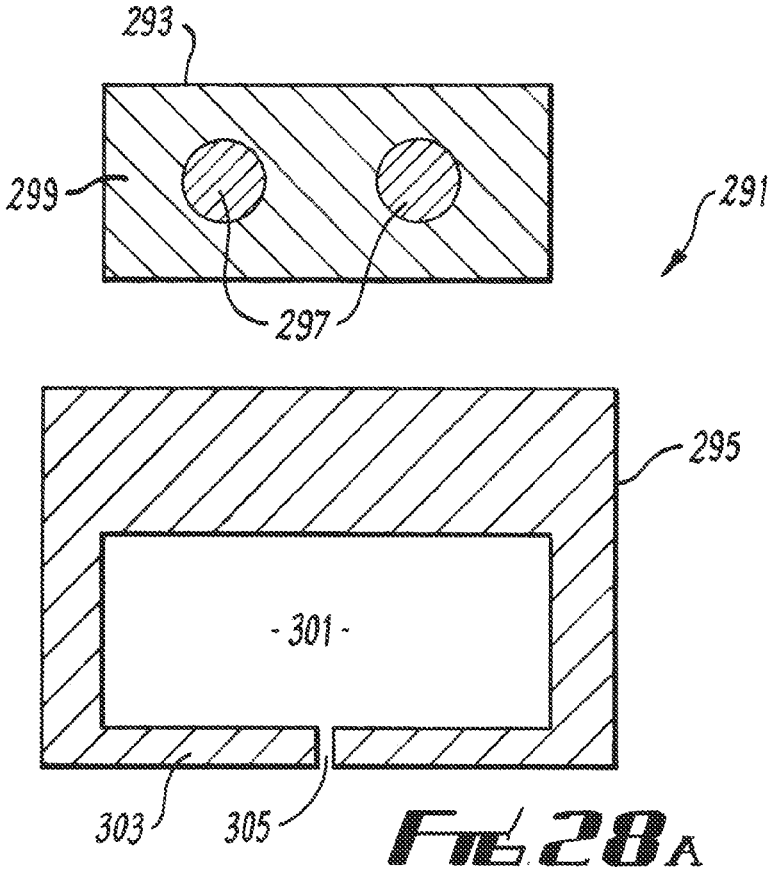
FIGS. 28A and 28B are cross-sectional views of a sealing member according to a further alternative embodiment of the invention.
Figure 28B:
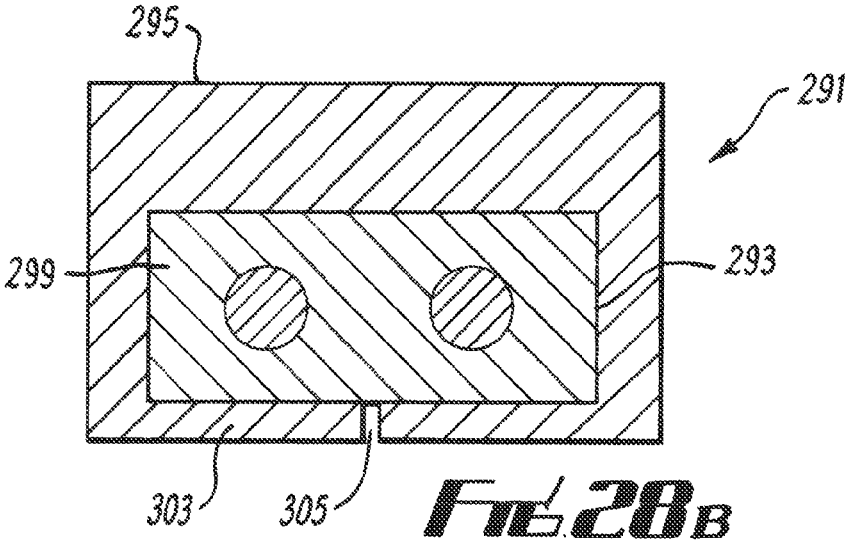

FIGS. 28A and 28B show in cross-section a sealing member according to a further alternative embodiment of the invention, shown generally at 291. The sealing member 291 is formed from a core in the form of an encapsulated cable 293, and a sheath 295 formed from an expanding material such as EPDM. FIGS. 28A and 28B show the components in unassembled and assembled form respectively.

The encapsulated cable 293 comprises a pair of control lines 297 encapsulated in a plastic insulating body 299. The sheath 295 has a substantially c-shaped profile which defines a formation 301 for receiving the core. Base layer 303 of the sheath 295 is formed in two parts with a split 305 that allows the base layer to be parted and the formation to be accessed. The core is inserted into the sheath 295 and the resilient nature of the sheath tends to close the two parts of the base layer and retain the core in the sheath. The core may be adhered or bonded to the sheath using a suitable bonding agent if required.

The assembled sealing member 291 shown in FIG. 28B may then be used in the manner described above, for example to create a downhole packer. This embodiment has the advantage that a sealing member can be created with different properties by the combination of sheaths and cores of different designs. For example, the sheath may be used to encapsulate a core of expanding material having a different swelling characteristic to create a hybrid sealing member. The core may function as the substrate, or may be arranged to convey a fluid or a signal through the sealing member.

It will be appreciated that the although the sealing member 291 is configured as a sheath and insert, it may instead be configured as one or more expanding components coupled to a core, a layer or another elongating component, which may have different physical properties to the expanding component. Advantageously the expanding component or components will at least partially encapsulate the core to facilitate the provision of a seal.

Figure 29A:
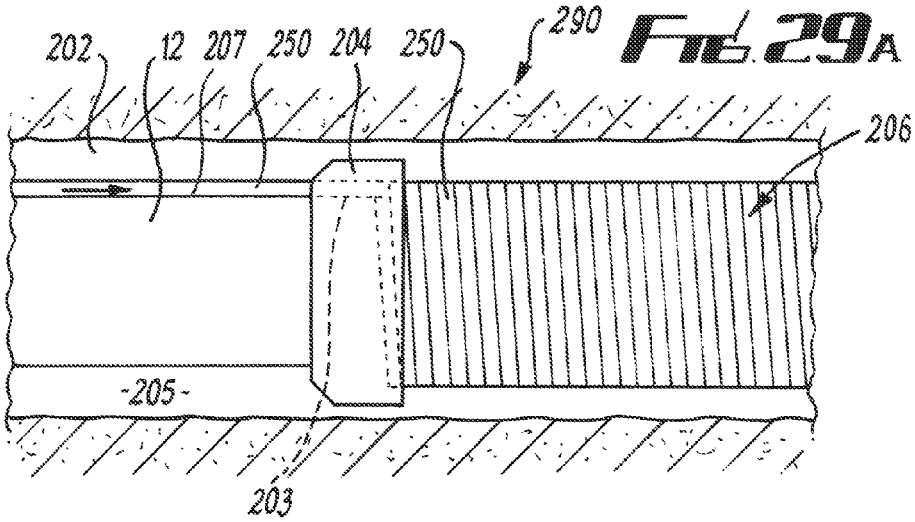
FIGS. 29A and 29B are schematic longitudinal views of a packer constructed from the sealing member of FIG. 24.
Figure 29B:
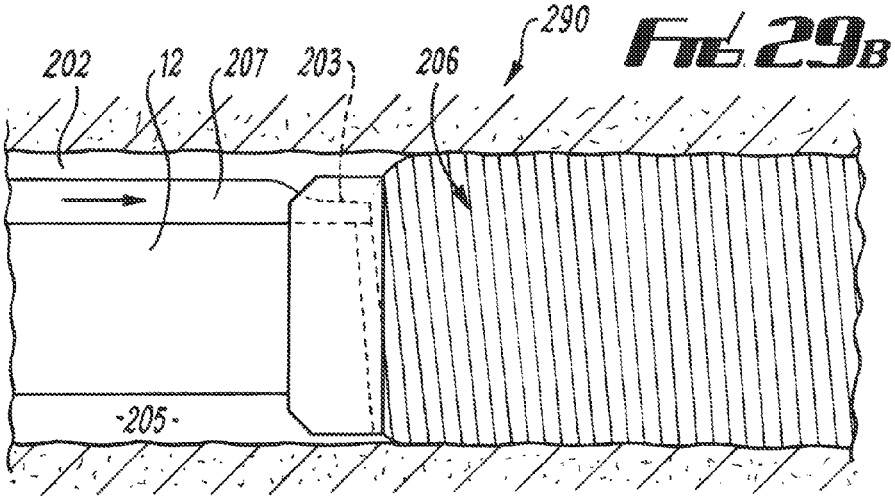

FIGS. 29A and 29B show schematically an alternative packer configuration, generally depicted at 290, in-situ in a wellbore 202 in unexpanded and expanded conditions. In this embodiment, the packer 290 is formed from a sealing member 250 (as described with reference to FIG. 24) applied to a tubular 12. An end ring 204 is provided over the end of the expanding portion 206, and a similar end ring is provided at the opposing end of the expanding portion (not shown). The end ring 204 is similar to the end ring described with reference to FIGS. 6A and 6B, although in this case a longitudinal recess 203 extends through the end ring 204 to allow the sealing member 250 to pass beneath it.

In this embodiment, the packer is constructed by a method similar to that described with reference to FIGS. 5A to 5C. However, the method differs in that the expanding portion 206 is not started at an end of the sealing member 250. In contrast, the expanding portion 206 is formed by beginning to wrap the sealing member at a location distal from its end. In fact, there may be many tens or hundreds of meters of sealing member 250 provided above the point to which the sealing member is wrapped around a tubular 12. At the desired location for forming the packer, the sealing member is redirected from a longitudinal direction to a circumferential direction and is wrapped around the tubular 12. This redirection may be accomplished with the assistance of a temporary clamp. The end ring 204, which in this case is in two-part, hinged form, is clamped around the sealing member, with the longitudinal recess 203 located over the sealing member. The sealing member is wrapped around the tubular to create the expanding portion 206. It may be necessary to adjust the position of the end ring to ensure that it is tightly placed against the end of the expanding portion 206. The portion 207 of the sealing member 250 located above the packer may be secured to the tubular body 12, for example by cable clamps, and may be coupled to control equipment, such as a source of hydraulic fluid. The cable clamps may be configured to be clamped over an upset on the tubular body 12 such as a tubing or casing coupling.

FIG. 29B shows the packer in-situ and the wellbore after expansion. The expanding portion has expanded against the formation to create a seal in the annulus 205. In addition, the portion 207 of the sealing member located above the packer 290 has expanded due to its exposure to wellbore fluid. However, the portion 207 above the packer is substantially longitudinally oriented, and therefore does not create a seal with the annulus 205. In addition, this portion 207 of the sealing member is not restrained laterally. This means that it is liable to expand proportionally less in the radial direction of the tubular 12, when compared with the coiled portion of the sealing member, which is laterally bound.

Although the packer creates a seal in the annulus, there is continuous path from the region above the packer to a region below the packer, via the conduit provided in the sealing member 250. In this example, the path is a hydraulic line for the supply of hydraulic fluids. In other embodiments, this conduit can be used for the deployment of fluids, cables, fibre optics, hydraulic lines, or other control or data lines across the seal.

One specific exemplary application of the invention is to artificial lift systems using electric submersible pumps (ESPs). In ESP systems it will typically be necessary to deploy a power cable from surface to the ESP, through a packer which creates an annular seal.

In the above-described embodiments, the sealing members have substantially rectangular cross-sectional profiles. In the examples shown, the sealing member has a width in the range of 5 mm to 100 mm, and a height in the range of 5 mm to 80 mm, in its unexpanded condition. Other cross-sectional profiles may also be used, and there will now be described a number of alternative examples, with reference to FIGS. 30 to 42.

Figure 30:
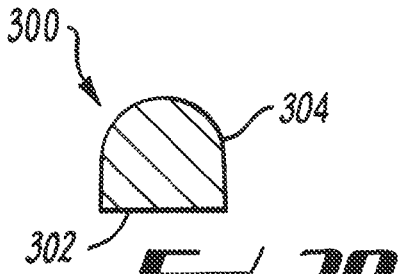
FIGS. 30 to 32 are cross-sectional views of sealing members in accordance with further alternative embodiments of the invention.
Figure 31:
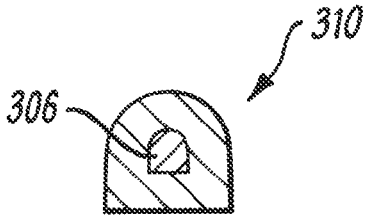

FIG. 30 shows in cross-section a sealing member 300 having a flat bottom surface 302 and a continuously curved upper surface 304 which defines the sides and the top of the sealing member 300. FIG. 31 shows a sealing member 310, similar to a sealing member 300, parts comprising a core 306 of a high strength material, such as a metallic mesh, which allows fluid flow through the sealing member.

Figure 32:
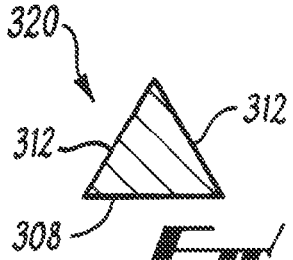

FIG. 32 shows in cross-sectional a sealing member 320 having a triangular profile. The sealing member 320 defines a flat bottom surface 308, and flat side surfaces 312.

Figure 33A:
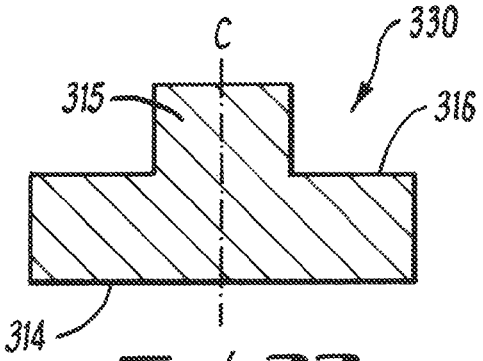
FIGS. 33A and 33B are alternative cross-sectional views of a sealing member in accordance with a further embodiment of the invention.
Figure 33B:
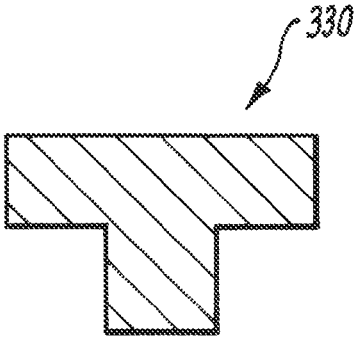

FIG. 33A shows in cross-section a sealing member 330, having a "T-shaped" profile. The sealing member 330 defines a flat bottom surface 314 and stepped side surfaces 316 defining a protruding spine 315. The sealing member is symmetrical about a central axis C. FIG. 33B shows the same sealing member 330 in an inverted position, in which the sealing member may also be applied to a body.

Figure 34A:
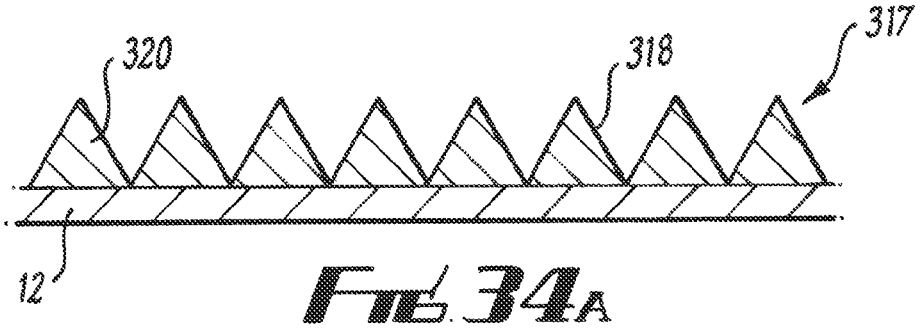
FIGS. 34A and 34B schematically show the application of the sealing member of FIG. 32 to a body.
Figure 34B:
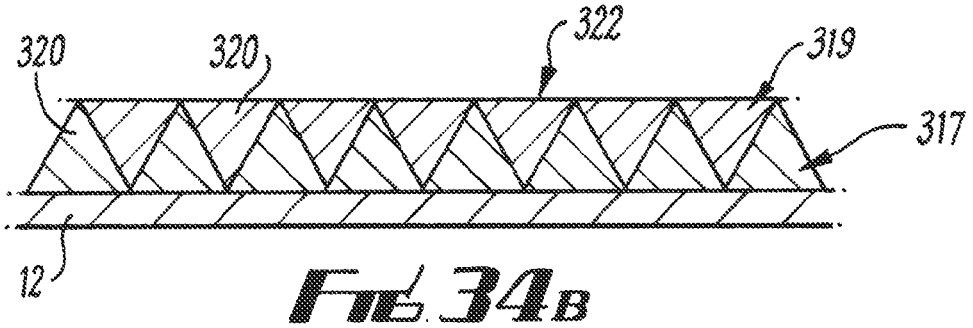

FIGS. 34A and 34B schematically show the application of the sealing member 320 to the surface of a tubular body 12. The sealing member 320 is wrapped onto the tubular body 12 according to the methods described above. This creates a layer 317 with a ridged profile 318, shown in FIG. 34A. Subsequently, a second layer 319 of sealing member 320 is wrapped over the first layer 317, with successive turns of the sealing member located in grooves created by the first layer 317. The resulting structure is an expanding portion 322 with a cylindrical outer surface.

The second layer 319 of the sealing member could be wrapped in the same direction as the first layer, or alternatively could be wrapped in the opposite direction. In some embodiments, the second layer 319 of the sealing member could be formed from the same length of sealing member, without cutting between layers. In other embodiments, the second layer 319 may be formed from a sealing member having a different profile, or indeed different material characteristics. For example, the second layer 319 of sealing member may be selected to swell in hydrocarbon fluid at a different rate from the first layer 317.

Figure 35A:
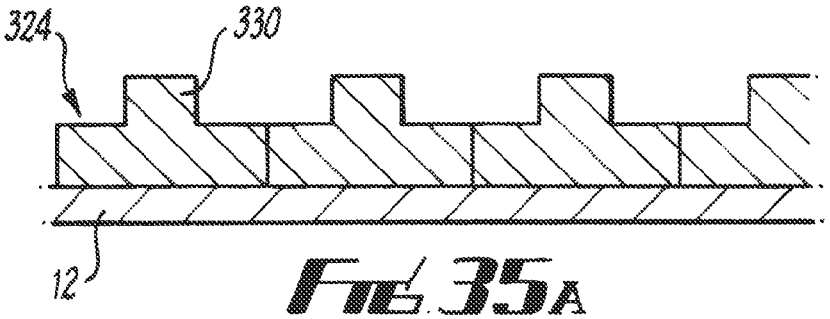
FIGS. 35A and 35B schematically show the application of the sealing member of FIG. 33 and another sealing member to a body according to one embodiment.
Figure 35B:
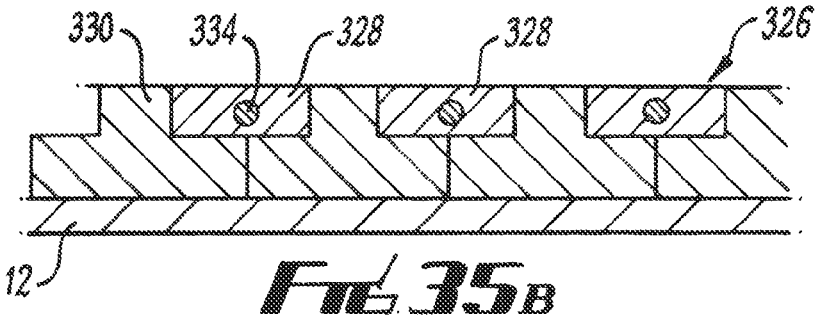

FIGS. 35A and 35B schematically show the application of the sealing member 330 to a tubular body 12. The process is similar to that described with reference to FIGS. 34A and 34B. A first layer 324 of the sealing member is formed on the tubular body by the rapid process as described above. The second layer 326 of a different sealing member 328 is wrapped into formations defined by the profile of the sealing member 330. In this embodiment, the sealing member 328 comprises an outer layer 332 surrounding an electrical conducting core 334.

Figure 36A:
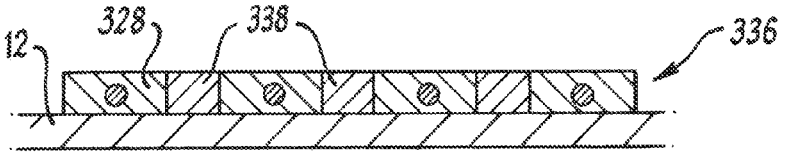
FIGS. 36A to 36C schematically show the application of the sealing member of FIG. 33 and another sealing member to a body according to an alternative embodiment.
Figure 36B:
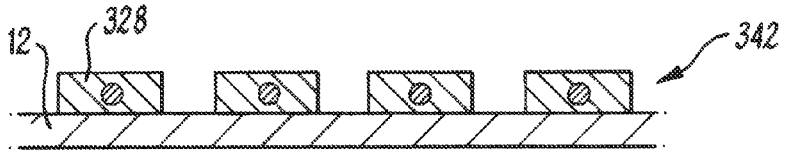
Figure 36C:
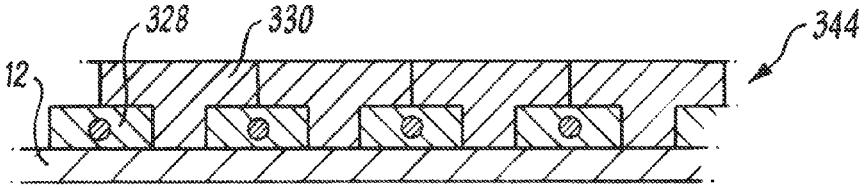

FIGS. 36A to 36C schematically show the application of the sealing members 330 and 328 in an alternative configuration. Sealing member 328 is wrapped in a first layer 336 on the tubular 12. The sealing member is wrapped adjacent a spacing member 338, which may be wrapped simultaneously with the sealing member 328, or in a consecutive application step. When the positioning and tension of the sealing member 328 is satisfactory, the spacing member 338 is removed to leave a spaced layer 342 of the sealing member 328 on the tubular body, as shown in FIG. 36B. In a subsequent step, a second layer 344 of the sealing member 330 is applied to the space layer 342 in an inverted configuration, such that the protrusion of the T shaped profile is received in the spaces left by the spacing member.

Figure 37:
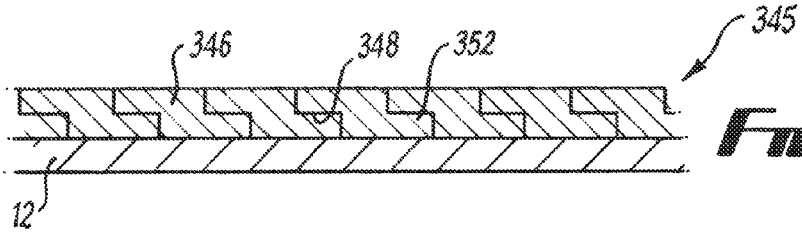
FIGS. 37 and 38 schematically show expanding portions formed from sealing members according to alternative embodiments of the invention.

FIG. 37 schematically shows an expanding portion 345 formed from a sealing member 346 in accordance with an alternative embodiment of the invention. The sealing member has a stepped profile. One side of the sealing member 346 has a recess 348, which corresponds to the shape of a protrusion 352 on the opposing side of the sealing member 346. Thus the opposing sides of the sealing member 346 are shaped to fit together with one another in an interlocking fashion, such that consecutive turns of the sealing member self locate with one another.

Figure 38:
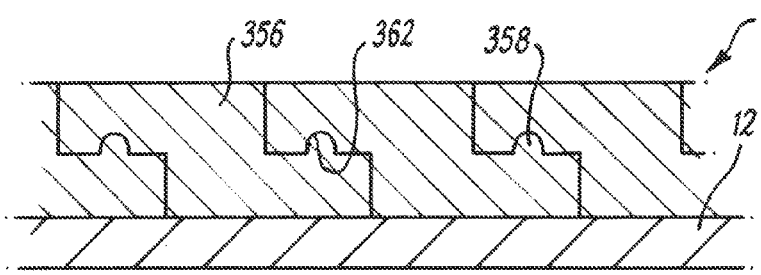

FIG. 38 schematically shows an expanding portion 354 formed from a sealing member 356. The sealing member 356 is similar to the sealing member 346, having a stepped profiled such that the opposing sides are shaped to fit together. However, in this embodiment, the sealing member 356 includes a ridge 358 which corresponds with a groove 362 to create an interlocking profile which self-locates and resists lateral separation.

Figure 39:
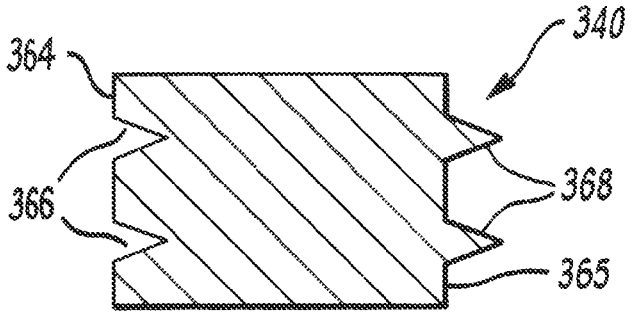
FIGS. 39 and 40 are cross-sectional views of sealing members in accordance with further alternative embodiments of the invention.

FIG. 39 shows a sealing member 340 in cross-sectional profile. The sealing member 340 is substantially rectangular profile, but includes on one side wall 364 a pair of longitudinally extending grooves 366 which corresponds with a pair of longitudinally extending ridges 368 on the opposing side wall 365. In use, the ridges 368 are located in the grooves 366 of an adjacent turn on a tubular body 12.

Figure 40:
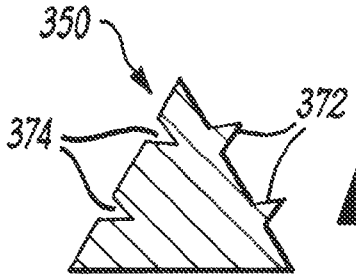

FIG. 40 shows a cross-section a further sealing member 350 comprising a triangular profile and pairs of corresponding ridges 372 and grooves 374, which function in a similar manner to the ridges and grooves of sealing member 340, but in the layered configuration shown in FIG. 33B.

Figure 41:
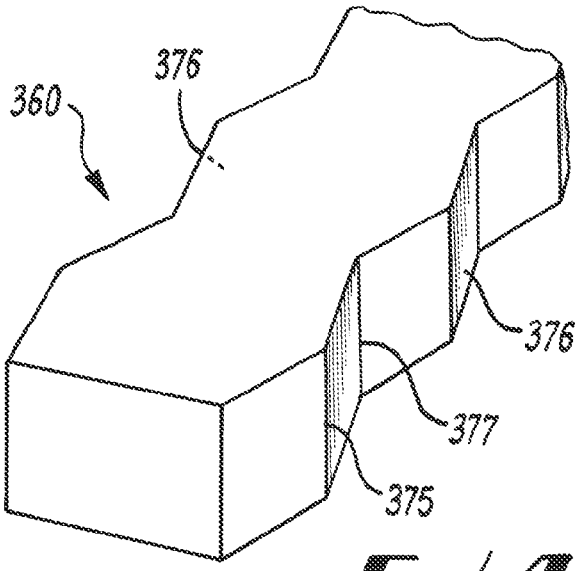
FIG. 41 is a perspective view of a sealing member in accordance with a further alternative embodiment of the invention.

FIG. 41 shows a perspective view of a sealing member 360 in accordance with a further alternative embodiment of the invention. The sealing member 360 has a substantially rectangular cross-sectional profile, but one which varies in dimensions over the length of the sealing member 360. The side walls 376 are formed into a series of angular ridges 375 and grooves 377 with corresponding profiles on the opposing walls. In use, the grooves formed in the side wall of one turn of the sealing member on the body receive ridges of the side wall of an adjacent turn. This arrangement increases the surface area of the interface between adjacent turns, and assists in the retention of tension in the turns forming the expanding portion.

Figure 42:
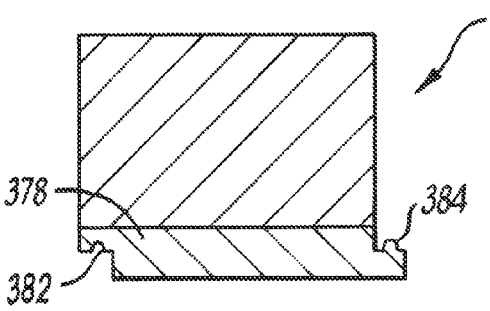
FIG. 42 is a cross-sectional view of a sealing member in accordance with a further alternative embodiment of the invention.

A further alternative embodiment of the invention shown in FIG. 42, which is a cross-sectional view of a sealing member 370 comprising a substantially rectangular profile and a supporting substrate 378. In this embodiment, the supporting substrate provides interlocking formations 382, 384 such that adjacent turns of the sealing member 370 self-locate and resist lateral separation in use.

The foregoing description relates primarily to the construction of wellbore packers on tubulars. It will be appreciated by one skilled in the art that the invention is equally applicable to packers formed on other apparatus, for example mandrels or packing tools which are run on a wireline. In addition, the present invention has application to which extends beyond conventional packers. The invention may be particularly valuable when applied to couplings and joints on tubulars and mandrels. The invention can also be applied to coiled tubing, for use in coiled tubing drilling or intervention operations. Furthermore, the body need not be cylindrical, and need not have a smooth surface. In some embodiments, the body may be provided with upstanding formations or inward recesses with which a sealing member cooperates on the body.

The sealing member could also be used on components such as sliding sleeves, or components which are not longitudinally oriented in a pipeline or wellbore.

The sealing member could be applied over many consecutive lengths of coupled tubulars, continuously over pipe couplings, or in discrete sections. The sealing member could be used to secure and seal casings during wellbore construction. The present invention provides a system which is sufficiently flexible and cost-effective over long seal lengths to replace the use of cement in many applications.

Figure 43:
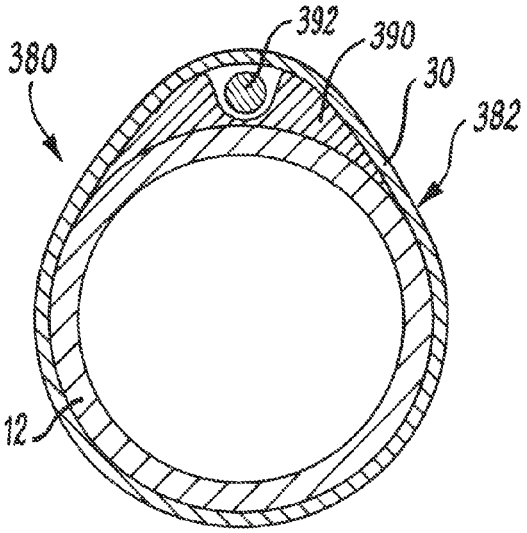
FIG. 43 is a cross-sectional view of a cable encapsulation assembly in accordance with an embodiment of the invention.
Figure 44:
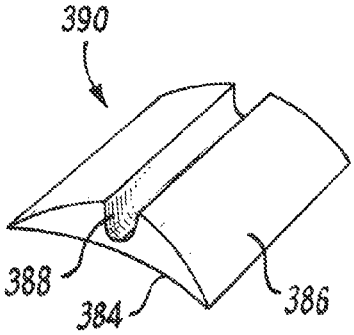
FIG. 44 is a perspective view of a support element used in the assembly of FIG. 43.

The invention also has applications in the encapsulations of tools, cables and downhole probes and sensors. FIG. 43 schematically shows such an application in cross-section. In this assembly, generally shown at 380, comprises a sealing member 30 wrapped around a tubular 12 to form an expanding portion 382. The assembly comprises a support element 390, also shown in perspective view in FIG. 44. The support element 390, which could be made from swellable elastomer, plastic or metal, comprises a part-circular inner profile 384, and a curved outer surface 386. A longitudinal groove 388 is formed in the outer surface and accommodates a cable 392 when the support element is located longitudinally on the tubular 12. The sealing member 30 is wrapped around the tubular 12 and the support element 390, with the cable extending through the groove 388.

Figure 45:
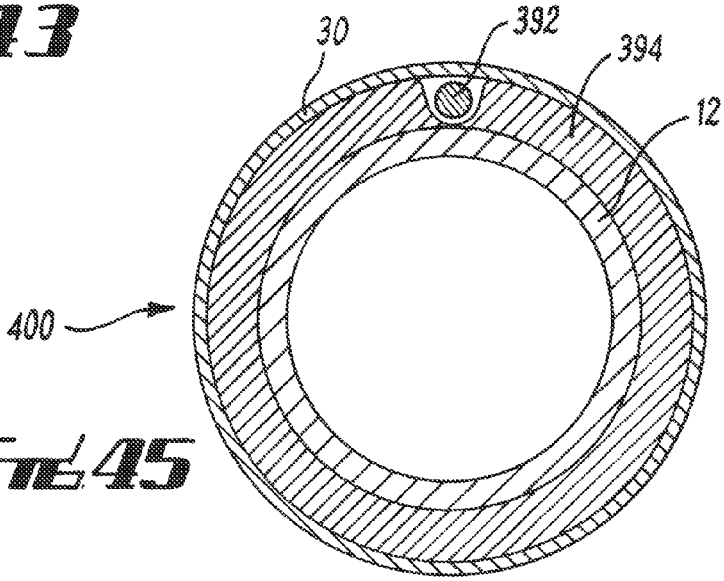
FIG. 45 is a cross-sectional view of a cable encapsulation assembly in accordance with a further embodiment of the invention.

In the arrangement of FIG. 43, the expanding portion 382 is of elliptical cross-section. This may be acceptable in some applications. For example, where the radial extent of the support member is small in comparison to the tubular outer diameter and/or outer diameter of the expanding portion in its expanded condition such that the eccentricity is small, the expanding portion may readily form a seal in the annulus. FIG. 45 shows in cross-section an alternative embodiment of the invention, generally depicted at 400, in which the support member 394 as a circular outer profile which supports the sealing member in use. The arrangements of FIGS. 43 to 45 could be used as an alternative to cable clamps.

Although the foregoing description relates to the use of the invention for creating a seal between the body and a surface exterior to the body, the principles of the invention can equally be used to create an annular seal between a body and a surface internal to the body. An example of such application is illustrated with reference to FIGS. 46 to 48.

Figure 46:
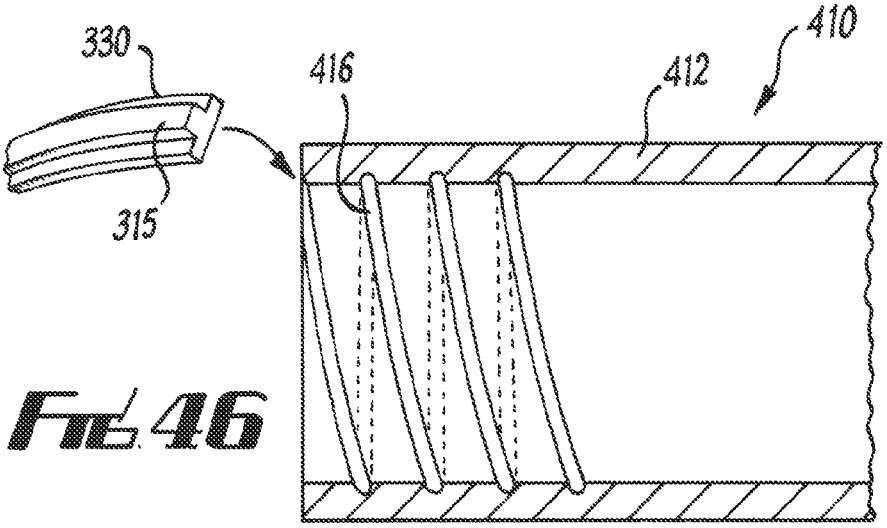
FIG. 46 is a schematic view of a part of an overshot tool in accordance with an embodiment of the invention.

FIG. 46 shows a lower part of an overshot tool 410, comprising a tubular 412. An upper part (not shown) of the tool is configured for connection to a toolstring. The tubular 412 has an open end 414, and an internal surface having a recessed thread 416 dimensioned to accommodate a sealing member 330, shown in detail at FIG. 33A. The protruding spine 315 of sealing member 330 is fed into the thread 416. The sealing member is selected to be resilient, such that feeding it into the thread and coiling it internally to the tubular 412 tends to cause a resultant straightening force which biases the sealing member against the internal surface and retains it in the thread. The sealing member 330 is fed to create multiple turns of the around the longitudinal axis of the tubular, with side walls of successive turns in abutment. In this embodiment, the sealing member creates a cylindrical protrusion to the inner surface of the tubular, but in alternative embodiments the sealing member is flush with the inner surface or recessed in the thread.

Figure 47A:
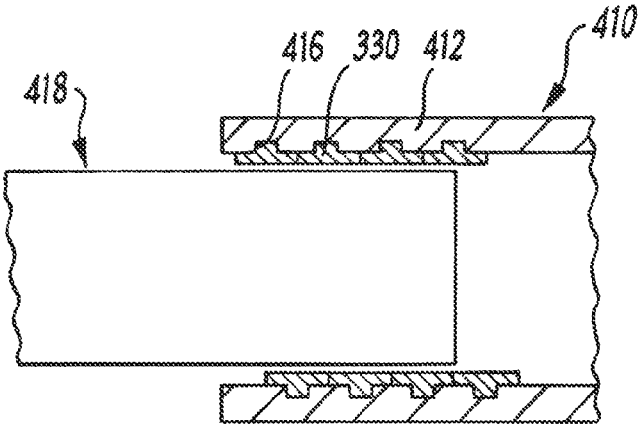
FIGS. 47A and 47B schematically show an application of the tool of FIG. 46 in accordance with an embodiment of the invention.
Figure 47B:
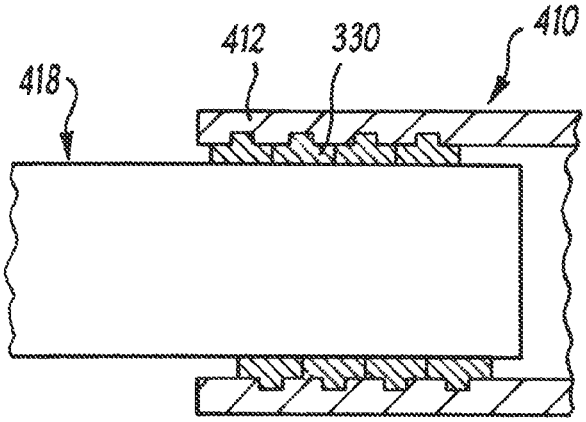

The open end of the tubular is sized to be placed over (or to overshoot) a body 418 in a wellbore, which may be a cut casing, as shown in FIG. 47A. The overshot tool 410 comprises additional mechanisms (not shown) for engaging the body 418. With the body surrounded, exposure of the sealing member to wellbore fluid causes expansion of the sealing member to form an annular seal between the tool and the body, as shown in FIG. 47B.

The present invention also has application to expansion joints. The sealing member may be used to create a seal between a polished mandrel and an outer tubular of a telescopic overshot tool that can accommodate axial expansion and contraction of the tubular or mandrel through changes in ambient temperature. Typically travel for expansion joints can be up to 6 m to 9 m (20-30 feet), and the invention provides a suitable means for creating a seal over this range of distances.

The present invention relates to sealing apparatus for use downhole, a sealing member, a method of forming a downhole apparatus, and methods of use. The sealing member of the invention may be conveniently used in isolation tools and systems, in cased and uncased holes. The invention provides sealing mechanisms and isolation tools and systems which may be manufactured and assembled more efficiently than in the case of the prior art, and which are flexible in their application to a variety of wellbore scenarios.

By creating a sealing arrangement from an elongated member, it may be easier to assemble the apparatus when compared with conventional slip-on apparatus. For example, the apparatus could be formed on a central 2 meter portion of a 12 meter casing section. The sealing member is economical to manufacture, compact to store, and easy to handle when compared with the materials used in conventional swellable packers.

The process of forming the packer offers several advantages. Firstly, the process does not require specialised equipment requiring large amounts of space or capital expenditure. The process can be carried out from a central portion of the tubular body, by attaching a first end of the sealing member and coiling it around the tubular, reducing the difficulties associated with slipping tool elements on at an end of the tubular and sliding them to the required location. This facilitates application of the sealing member to significantly longer tubulars, and opens up the possibility of constructed packer on strings of tubing on the rig floor immediately prior to or during assembly. The construction process allows for a high degree of flexibility in tool design. For example, a packer of any desired length can be created from the same set of components, simply by adjusting the length over which the sealing member is coiled on the tubular body. Packers and seals can be created on bodies and tubulars of a range of diameters. The principles of the invention also inherently allow for engineering tolerances in the dimensions of bodies on which the seal is created.

The resulting packers may have increased surface area with respect to an equivalent packer with an annular mantle, allowing for faster expansion to the sealing condition. The elongated sealing member also lends itself well to post-processing, for example perforating, coating or performing analysis on a sample.

The use of a substrate or a material with different mechanical characteristics in the sealing member allows more tension to be applied and retained in the sealing member during the construction process, and reduces any tendency of the sealing member to swage. It also binds to the swellable material, and resists expansion of the sealing member in a longitudinal direction.

The invention can be used to create a seal in the annulus with a continuous path from region to above the seal to a region below the seal, via the conduit provided in the sealing member. For example, the path is a hydraulic line for the supply of hydraulic fluids. In other embodiments, this conduit can be used for the deployment of fluids, cables, fibre optics, hydraulic lines, or other control or data lines across the seal. One specific application of the invention is to artificial lift systems using electric submersible pumps (ESPs). A sealing member in one aspect of the invention comprises a power cable for an ESP.

It will be appreciated by one skilled in the art that the invention is applicable to packers formed tubulars, mandrels, or packing tools which are run on a wireline. In addition, the present invention has application to which extends beyond conventional packers. The invention may be particularly valuable when applied to couplings and joints on tubulars and mandrels. The invention can also be applied to coiled tubing, for use in coiled tubing drilling or intervention operations.

The sealing member could be applied over many consecutive lengths of coupled tubulars, continuously over pipe couplings, or in discrete sections. The sealing member could be used to secure casings during wellbore construction. The present invention provides a system which is sufficiently flexible to replace the use of cement in many applications. The principles of the invention can equally be used to create an annular seal between a body and a surface internal to the body.

Variations to the above described embodiments are within the scope of the invention, and combinations of features other than those expressly claimed form part of the invention. Unless the context requires otherwise, the physical dimensions, shapes, internal profiles, end rings, and principles of construction described herein are interchangeable and may be combined within the scope of the invention. For example, any of the described internal profiles of sealing member may be used with the described external profiles. The principles of construction described above may apply to any of the described profiles, for example, the described bonding method or the heat curing method may be used with any of the sealing members described. Additionally, although the invention is particularly suited to downhole use it may also be used in topside and subsea applications such as in pipeline systems. It may also be used in river crossing applications.

What is claimed is:

1. An apparatus comprising:

a body having a longitudinal axis; and a sealing arrangement located on the body, comprising:

at least one elongated sealing member comprising a swellable material, wherein the sealing member has an axis of elongation extending around the longitudinal axis of the body, and wherein the sealing member extends around an inner surface of the body and is configured to form an annular seal in use, wherein the body comprises a recessed thread dimensioned to accommodate the at least one elongated sealing member.

2. The apparatus of claim 1, wherein the sealing member is coiled on the body.

3. The apparatus of claim 2, wherein the sealing arrangement comprises a plurality of turns of the elongated sealing member formed on the body such that a lower edge of a turn abuts an upper edge of a successive turn and creates a seal with the upper edge of the successive turn.

4. The apparatus of claim 1, wherein the apparatus is configured as an overshot tool, an expansion joint, or an end of a tubular in a downhole or subsea location.

5. The apparatus of claim 4, wherein the apparatus is configured as an overshot tool and comprises:

a tubular body; and an opening configured to be disposed over a body to which the overshot tool is to be coupled in use, and wherein the sealing arrangement is arranged on the inner surface of the tubular body.

6. The apparatus of claim 5, wherein the sealing member creates a cylindrical protrusion to the inner surface of the tubular body.

7. The apparatus of claim 1, wherein the at least one elongated sealing member is flush with the inner surface or recessed in the thread.

8. The apparatus of claim 1, configured to form a seal with a cut casing.

9. The apparatus of claim 1, wherein the apparatus is configured as part of a telescopic expansion joint, and wherein the at least one elongated sealing member is configured to form a seal with a polished mandrel.

10. A sealing member for an apparatus, the sealing member comprising:

a swellable material, wherein the sealing member is elongated and is configured to be located on a body of an apparatus, wherein an axis of elongation of the sealing member extends around a longitudinal axis of the body, and wherein the sealing member is configured for disposal in a recessed thread on an inner surface of the body of the apparatus to form an annular seal between the body and a surface internal to the body.

11. The sealing member of claim 10, comprising a T-shaped profile.

12. The sealing member as claimed in claim 10, comprising a profile configured for interlocking multiple layers of the sealing member on the body.

13. The sealing member as claimed in claim 10, wherein the sealing member is resilient, such that coiling it internally to the body causes a resultant straightening force which biases the sealing member against the inner surface of the body.

14. The sealing member as claimed in claim 10, wherein the sealing member comprises one or more expanding components coupled to an elongate component which has different physical properties to the one or more expanding components.

15. The sealing member as claimed in claim 10, wherein the sealing member comprises a substrate and means for attaching an expanding component to the substrate.

16. A method of forming an apparatus, the method comprising the steps of:

providing a body having a longitudinal axis;

providing at least one elongated sealing member comprising a swellable material;

forming a sealing arrangement on an inner surface of the body by locating the at least one elongated sealing member on the inner surface of the body, with its axis of elongation extending around the longitudinal axis of the body, comprising:

feeding the elongated sealing member into a thread formed on the inner surface of the body; and coiling the elongated sealing member internally to the body; and running the apparatus to a downhole location such that the apparatus is disposed adjacent a surface, wherein the sealing arrangement forms an annular seal in use.

17. The method of claim 16, further comprising the step of forming multiple turns of the elongated sealing member on the inner surface of the body.

18. A method of forming a seal in a downhole or subsea environment, the method comprising the steps of:

providing a sealing apparatus formed from a tubular body and at least one elongated sealing member arranged in a recessed thread formed on an inner surface of the tubular body, the sealing member comprising a material selected to expand on exposure to at least one predetermined fluid;

running the sealing apparatus to a downhole or subsea location such that the sealing apparatus is disposed over a surface of a second body;

coupling the sealing apparatus to the second body; and exposing the elongated sealing member to at least one fluid to expand it to an expanded condition in which a seal is created between the body and the surface.

* * * * *